US012172044B2

(12) United States Patent
Yang

(10) Patent No.: US 12,172,044 B2
(45) Date of Patent: Dec. 24, 2024

(54) FITNESS EXERCISE APPARATUS

(71) Applicant: YANGZHOU JIUYI HARDWARE & MACHINERY CO., LTD., Jiangsu (CN)

(72) Inventor: Yen-Shuo Yang, Taichung (TW)

(73) Assignee: Yangzhou Jiuyi Hardware & Machinery Co., Ltd., Yangzhou (CN)

( * ) Notice: Subject to any disclaimer, the term of this patent is extended or adjusted under 35 U.S.C. 154(b) by 208 days.

(21) Appl. No.: 17/970,911

(22) Filed: Oct. 21, 2022

(65) Prior Publication Data

US 2024/0131387 A1 Apr. 25, 2024
US 2024/0226643 A9 Jul. 11, 2024

(51) Int. Cl.

*A63B 21/00* (2006.01)
*A63B 21/04* (2006.01)
*A63B 21/055* (2006.01)
*A63B 21/062* (2006.01)

(52) U.S. Cl.

CPC ..... *A63B 21/156* (2013.01); *A63B 21/0428* (2013.01); *A63B 21/0552* (2013.01); *A63B 21/0628* (2015.10); *A63B 2208/0233* (2013.01)

(58) Field of Classification Search

CPC ..... A63B 21/156; A63B 21/0428; A63B 21/0552; A63B 21/0628; A63B 21/4035; A63B 21/4043; A63B 21/154; A63B 21/04; A63B 21/0407; A63B 21/0435; A63B 21/0442; A63B 21/062; A63B 21/0624; A63B 21/0626; A63B 21/063; A63B 21/0632; A63B 2208/0233

See application file for complete search history.

(56) References Cited

U.S. PATENT DOCUMENTS 10,016,646 B2 * 7/2018 Butler ..... A63B 21/062
2006/0189457 A1 * 8/2006 Ripley ..... A63B 21/0552 482/99
2010/0016129 A1 * 1/2010 Chou ..... A63B 21/0626 482/97
2020/0222745 A1 * 7/2020 Leipheimer ..... A63B 23/03525
2021/0361997 A1 * 11/2021 Yang ..... A63B 21/0552
2022/0096891 A1 * 3/2022 Yang ..... A63B 21/0428

FOREIGN PATENT DOCUMENTS

CN 205683489 11/2016
CN 106730588 A * 5/2017

* cited by examiner

*Primary Examiner* — Megan Anderson
*Assistant Examiner* — Jonathan A Dicuia
(74) *Attorney, Agent, or Firm* — Burris Law, PLLC

(57) ABSTRACT

A fitness exercise apparatus includes a main frame, a seat unit, a resistance unit, a transmission unit, and an operating unit. The main frame includes a base seat and a support unit. The seat unit is mounted on the base seat. The resistance unit includes a weight subunit that is mounted on the main frame, and an elastic subunit that is connected between the weight subunit and the main frame. The transmission unit includes a first fixed pulley set, two second fixed pulley sets, two third fixed pulley sets, a first movable pulley, a movable pulley set, two second movable pulleys, a first cable, two second cables, and a third cable. The operating unit includes at least one operating member that is connected to one of the first and second cables.

11 Claims, 24 Drawing Sheets

FITNESS EXERCISE APPARATUS

FIELD

The disclosure relates to an exercise machine, and more particularly to a fitness exercise apparatus.

BACKGROUND

Referring to FIG. 24, a conventional exercise machine as disclosed in Chinese Utility Model Patent Publication No. CN 205683489 U is shown. The conventional exercise machine has a base seat 1, a first connecting pillar 8 that is perpendicular to and connected with the base seat 1, and a top beam 10 that is parallel to the base seat 1 and connected with the connecting pillar 8. The top beam 10 is connected to a first weight stack 3 via two first guiding posts 5 that are connected to the rear of the top beam 10. The top beam 10 includes a first fixed pulley 11 and a second fixed pulley 9 respectively mounted at a front end and a rear end of the top beam 10. The conventional exercise machine has a first steel cable 4 that has one end co-movably connected with a handle bar 12, and another end that is connected with the weight stack 3.

The conventional exercise machine allows a user to perform weight training by pulling the mounting bar 12 and lifting the weight stack 3.

However, the conventional exercise machine is only useful for weight training and is unsuitable for cardio training as the weight stack 3 is slow in responding to the user pulling the mounting bar 12. This is due to the inertia of the weight stack 3, which causes the weight stack 3 to have a delayed acceleration under gravity after it has reached its highest point in an upwards movement. Furthermore, friction between the weight stack 3 and the guiding posts 5, and between the steel cable 4 and the first and second fixed pulleys 11, 9 exacerbates the slow response. Therefore, the conventional exercise machine is unsuitable for aerobic exercises that require quick feedback and swift movements such as rowing, cross-training, or boxing.

SUMMARY

Therefore, an object of the disclosure is to provide a fitness exercise apparatus that can alleviate at least one of the drawbacks of the prior art.

According to the disclosure the fitness exercise apparatus includes a main frame, a seat unit, a resistance unit, a transmission unit, and an operating unit. The main frame includes a base seat and a support unit that is connected to the base seat. The seat unit is mounted detachably on the base seat. The resistance unit includes a weight subunit that is mounted on the main frame, and an elastic subunit that is connected between the weight subunit and the main frame. The transmission unit includes a first fixed pulley set, two second fixed pulley sets, two third fixed pulley sets, a first movable pulley, a movable pulley set, two second movable pulleys, a first cable, two second cables, and a third cable. The first fixed pulley set is mounted on the support unit, and the two second fixed pulley sets are mounted on the support unit. The two third fixed pulley sets are mounted on the base seat, and the first movable pulley is disposed above the base seat and is proximate to the support unit. The movable pulley set is disposed at a side of the first movable pulley, and the two second movable pulleys are disposed respectively at opposite sides of the first movable pulley. The first cable wraps around the first fixed pulley set, the first movable pulley and the movable pulley set. The two second cables each wrapping around a respective one of the second movable pulleys and a respective one of the second fixed pulley sets. The third cable wraps around the third fixed pulley set and the movable pulley set, and is connected to the second movable pulleys. The operating unit includes at least one operating member that is connected to one of the first and second cables and pulling of the first cable drives the first movable pulley to move upwardly, thereby resulting in movement of the weight subunit against an elastic force of the elastic subunit. A pulling of the second cables drives the second movable pulleys to move upwardly, thereby pulling the first cable via the third cable and the movable pulley set, and eventually resulting in movement of the weight subunit against an elastic force of the elastic subunit.

BRIEF DESCRIPTION OF THE DRAWINGS

Other features and advantages of the disclosure will become apparent in the following detailed description of the embodiment(s) with reference to the accompanying drawings. It is noted that various features may not be drawn to scale.

DETAILED DESCRIPTION

Figure 1:
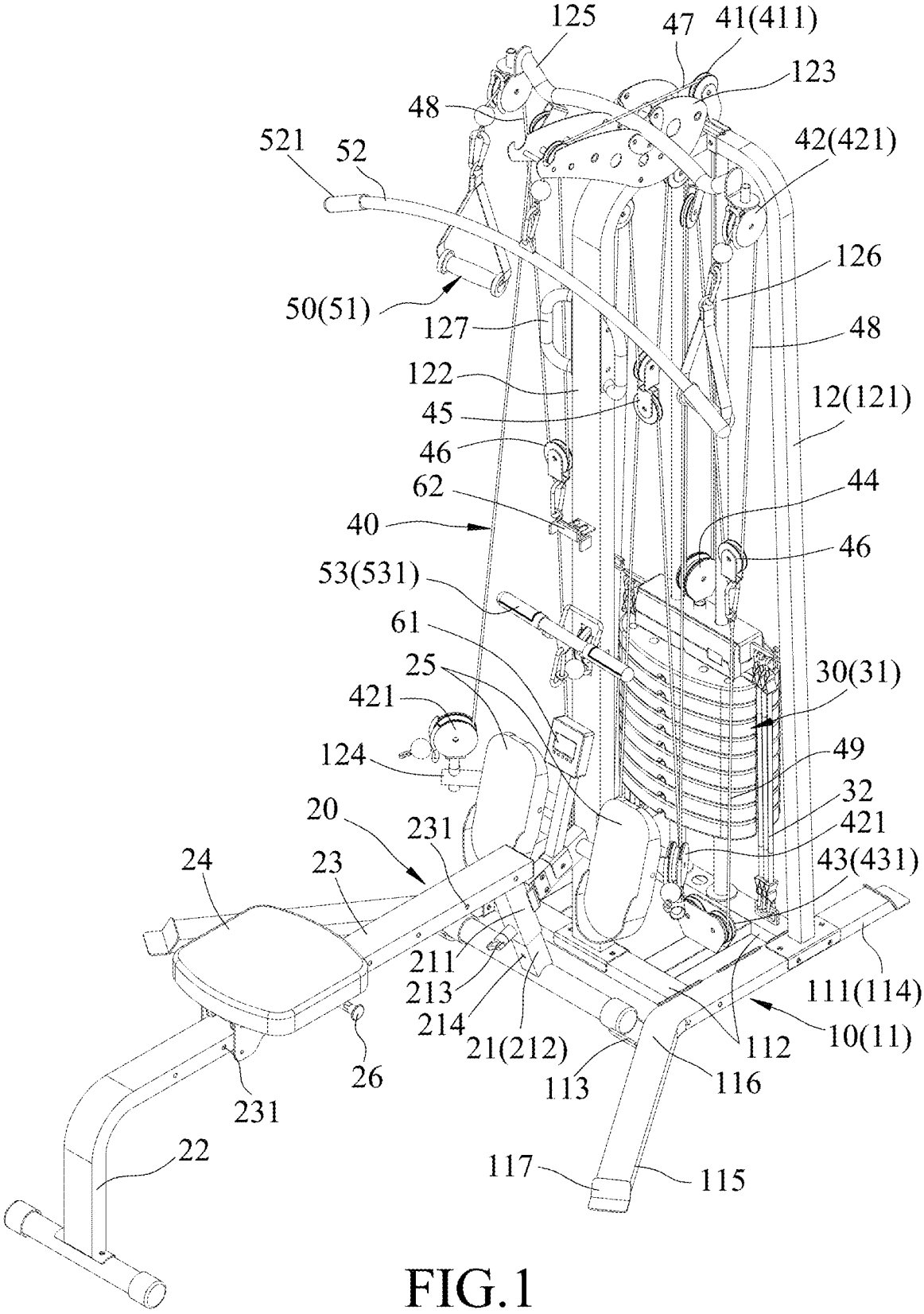
FIG. 1 is a perspective view illustrating an embodiment of a fitness exercise apparatus according to the present disclosure.

Before the disclosure is described in greater detail, it should be noted that where considered appropriate, reference numerals or terminal portions of reference numerals have been repeated among the figures to indicate corresponding or analogous elements, which may optionally have similar characteristics.

It should be noted herein that for clarity of description, spatially relative terms such as "top," "bottom," "upper," "lower," "on," "above," "over," "downwardly," "upwardly" and the like may be used throughout the disclosure while making reference to the features as illustrated in the drawings. The features may be oriented differently (e.g., rotated 90 degrees or at other orientations) and the spatially relative terms used herein may be interpreted accordingly.

Figure 2:
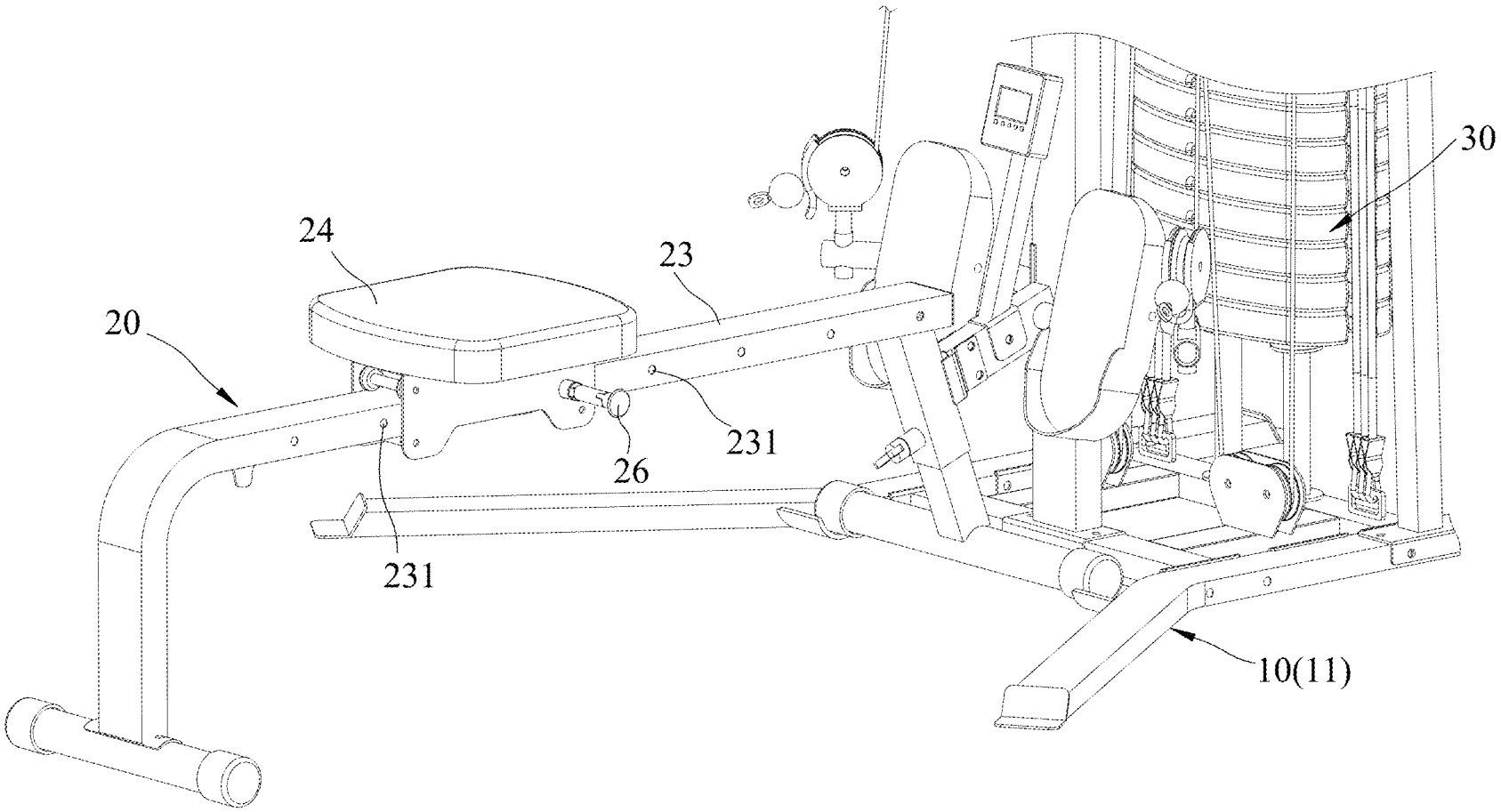
FIG. 2 is a fragmentary perspective view of a seat unit of the embodiment.

Referring to FIGS. 1 and 2, an embodiment of a fitness exercise apparatus according to the disclosure includes a main frame 10, a seat unit 20, a resistance unit 30, a transmission unit 40, and an operating unit 50.

Figure 5:
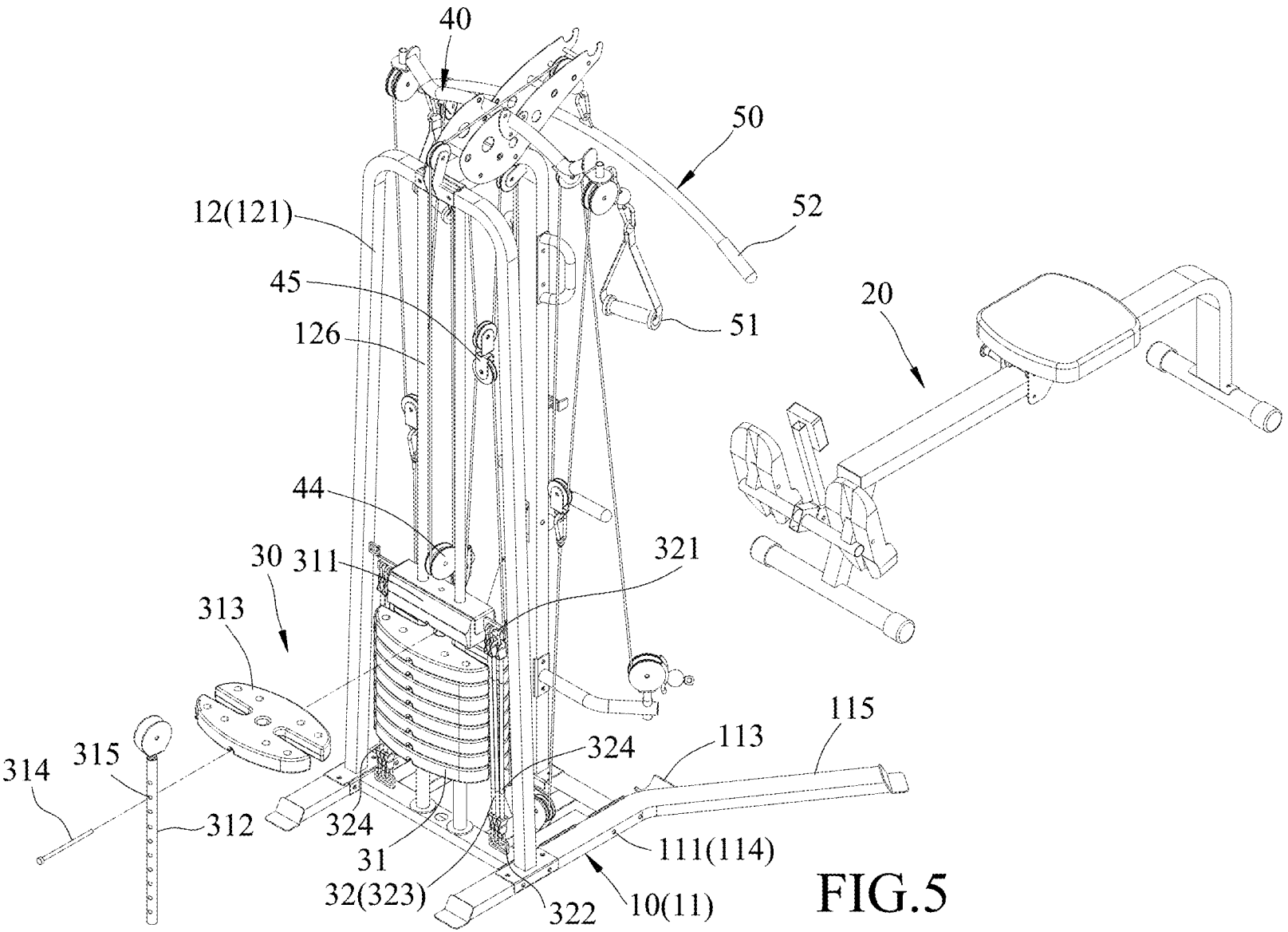
FIG. 5 is a schematic perspective partially exploded view of the embodiment.

Referring further to FIG. 5, the main frame 10 includes a base seat 11 and a support unit 12 that is connected to the base seat 11.

The base seat 11 includes two spaced-apart legs 111, a plurality of connecting rods 112 that are connected between the legs 111, and two retaining members 113. Each of the legs 111 of the base seat 11 has a base segment 114 and an inclined segment 115 that is transverse to the base segment 114, that has an inner end 116 connected to the base segment 114, and an outer end 117 opposite to the inner end 116. A distance between the inclined segments 115 of the legs 111 gradually increases from the inner ends 116 of the inclined segments 115 towards the outer ends 117 of the inclined segments 115. The retaining members 113 are half-round gutter shaped, are respectively connected fixedly to the inclined segments 115 of the legs 111.

The support unit 12 of the main frame includes a rear frame member 121, a front frame member 122, a hanging member 123, two lower mounting rods 124, an upper mounting rod 125, two guide rods 126, and a support handle 127. The rear frame member 121 is inverted U-shaped and connected to the two legs 111 of the base seat 11. The front frame member 122 is connected between the rear frame member 121 and the base seat 10, and is inverted L-shaped. The hanging member 123 is mounted on top of the front frame member 122. The two lower mounting rods 124 are connected respectively to opposite lateral sides of the front frame member 122 (see FIG. 12). The upper mounting rod 125 is mounted on the hanging member 123. The two guide rods 126 extend upwardly from the base seat 11 to the rear frame member 121, and the support handle 127 is mounted on the front frame member 122.

Figure 3:
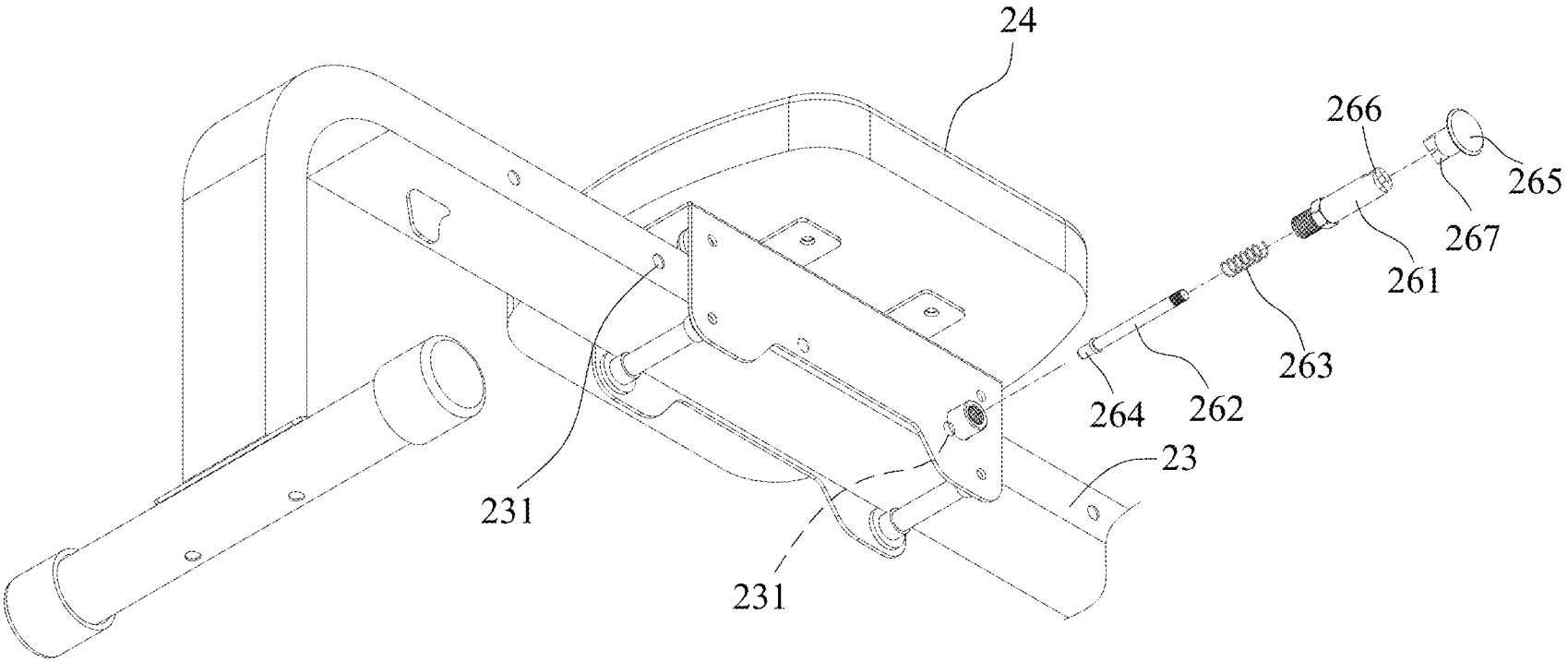
FIG. 3 is a fragmentary partially exploded perspective view showing the seat unit.
Figure 6:
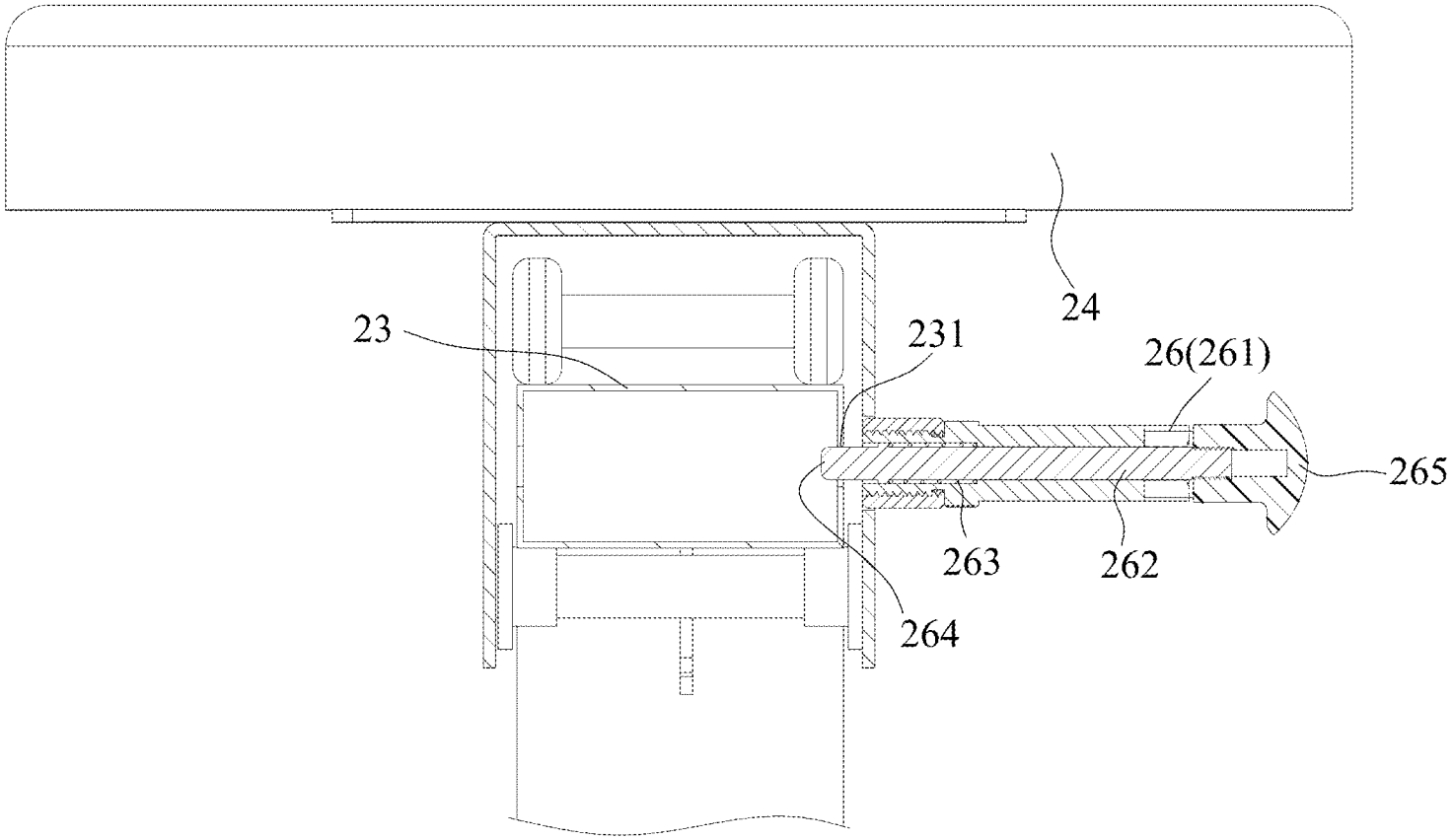
FIG. 6 is a fragmentary partially cross-sectional view illustrating the seat unit.

The seat unit 20 is mounted detachably on the base seat 11, and includes an inner leg member 21, and outer leg member 22, a guide rail 23, a seat member 24, two foot rests 25, and a latch unit 26. The inner leg member 21 is coupled removably to the retaining members 113. The guide rail 23 is connected between the inner leg member 21 and the outer leg member 22. The seat member 24 is mounted on the guide rail 23, the foot rests 25 are secured to the inner leg member 21, and the latch unit 26 is mounted to the seat member 24. The inner leg member 21 includes a stationary tube 211, an inner leg rod 212, and an adjusting component 213. The stationary tube 211 is connected transversely to the guide rail 23. The inner leg rod 212 is inverted T-shaped, and has two arms coupled removably and respectively to the retaining members 113 of the base seat 11. Moreover, the inner leg rod 212 is connected telescopically to the stationary tube 211 and is formed with a plurality of adjusting holes 214. The adjusting component 213 is inserted transversely into the stationary tube 211 and engages a selected one of the adjusting holes 214. Referring to FIGS. 3 and 6, the seat member 24 is capable of sliding relative to the guide rail 23 or capable of being securely affixed to the guide rail 23 via the latch unit 26. More specifically, the guide rail 23 has a plurality of securing holes 231 arranged lengthwise. The latch unit 26 has a latch pin 262, an outer sleeve 261 that is sleeved over the latch pin 262 and that has a groove 266, and a spring 263 that is sleeved on the latch pin 262 and that is disposed between the latch pin 262 and the outer sleeve 261. The latch pin 262 has a latch end 264 that can engage a selected one of the securing holes 231 of the guide rail 23 to securely fix the seat member 24 to the guide rail 23. The latch unit 26 further has a pull knob 265 opposite to the latch end 264 of the latch pin 262. The spring 263 biases the latch end 264 of the latch pin 262 against the guide rail 23, so that the latch pin 262 can remain securely engaged to the selected one of the securing holes 231 of the guide rail 23 when the latch end 264 of the latch pin 262 engages that securing hole 231. The pull knob 265 is connected fixedly to the latch pin 262, and has an index portion 267 that is registered with the groove 266 of the latch pin 262. When the seat member 24 is securely fixed to the guide rail 23 via the latch unit 26, and the index portion 267 of the pull knob 265 engages the groove 266 of the latch pin 262. The pull knob 265 can then be pulled to disengage the index portion 267 from the groove 266, and the pulling back of the pull knob 265 disengages the latch end 264 of the latch pin 262 from the securing hole 231 of the guide rail 23. At this moment, the pull knob 265 can be rotated 90 degrees so that the latch end 264 remains disengaged from the securing hole 231 by preventing the index portion 267 from engaging the groove 266 of the latch pin 262, thereby facilitating sliding movement of the seat member 24 relative to the guide rail 23.

Figure 7:
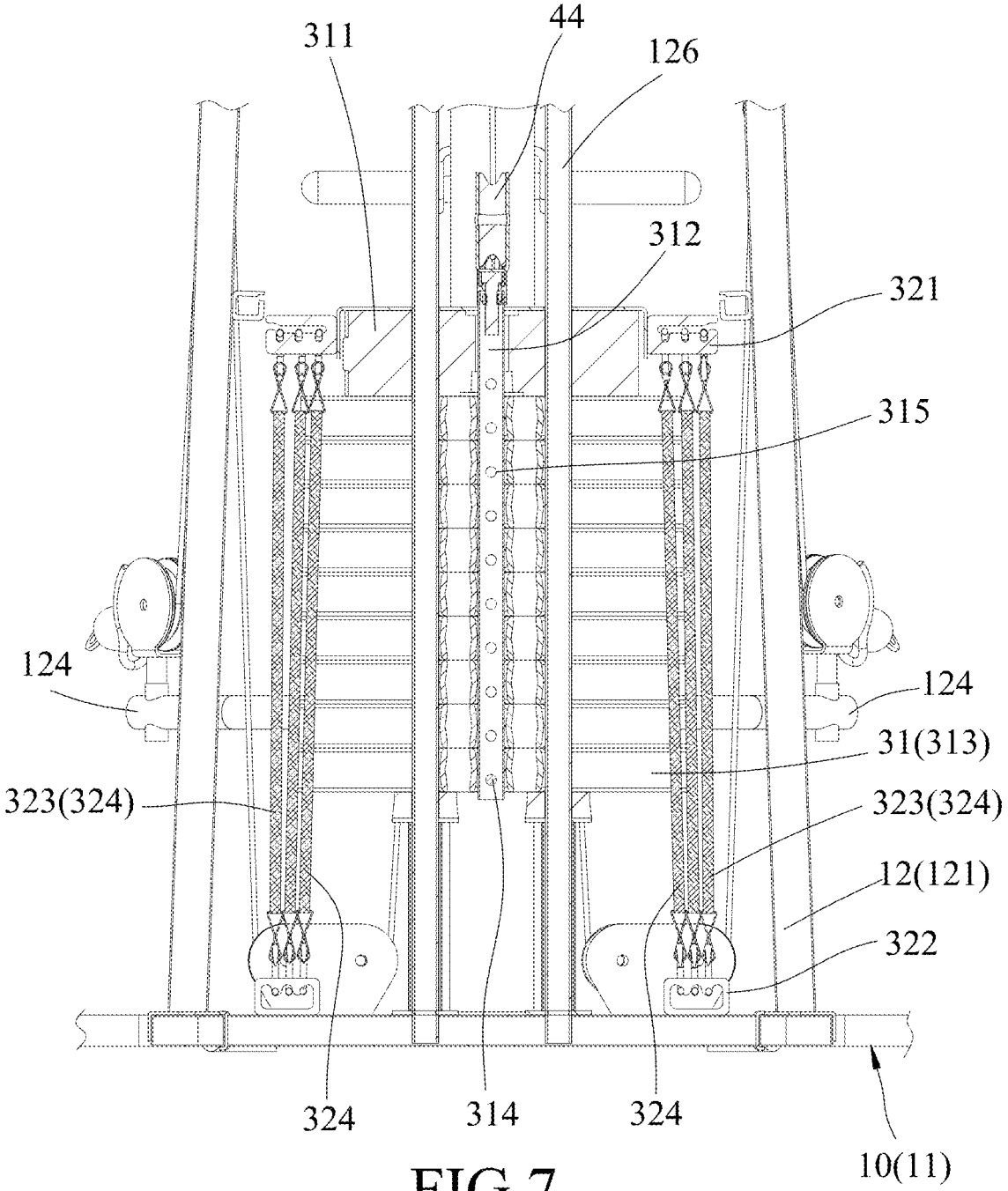
FIG. 7 is a fragmentary back view illustrating a resistance unit of the embodiment.

Referring to FIGS. 5 and 7, the resistance unit 30 includes a weight subunit 31 that is mounted on the main frame 10, and an elastic subunit 32 that is connected between the weight subunit 31 and the main frame 10. The weight subunit 31 includes a connecting seat 311 that is slidable along the guide rods 126, an adjusting rod 312 that extends through the connecting seat 311, a plurality of weight plates 313 that are slidably sleeved on the guide rods 126 and the adjusting rod 312, and an adjusting pin 314 that is inserted removably into a selected one of the weight plates 313 and the adjusting rod 312. The adjusting rod 312 has a plurality of pin holes 315. The elastic subunit 32 includes two elastic sets 323 that are disposed respectively at opposite sides of the weight subunit 31. Each of the elastic sets 323 includes a plurality of elastic strips 324, each of said elastic strips 324 has opposite ends that are connected respectively to the connecting seat 311 and the base seat 11. In this embodiment, the elastic subunit 32 further includes two upper hangers 321 that are mounted on the connecting seat 311 and that are disposed respectively on opposite sides of the two guide rods 126, and two lower hangers 322 that are mounted to the base seat 11 and that are disposed respectively on opposite sides of the two guide rods 126. Each of the elastic sets 323 is connected between a respective one of the upper hangers 321 and a respective one of the lower hangers 322. Specifically, for each of the elastic sets 323, the two opposite ends of the elastic strips 324 are respectively connected to the respective one of the upper hangers 321 and the respective one of the lower hangers 322. The number of the elastic strips 324 of the two elastic sets 323 are the same. In this embodiment, there are three elastic strips 324 in each elastic set 323, and the specifications of the elastic strips 324 of the elastic sets 323 are identical.

Figure 4:
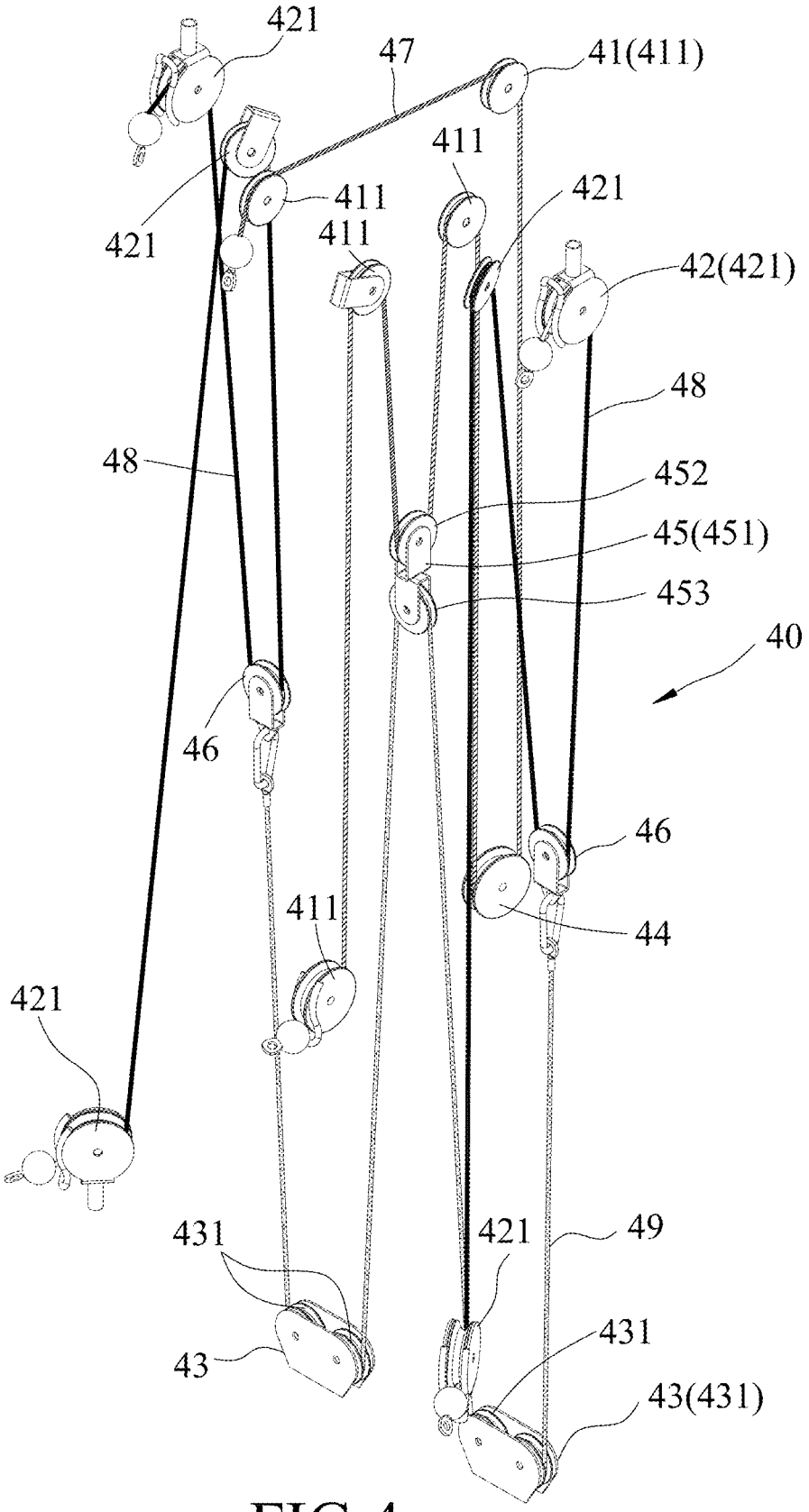
FIG. 4 is a schematic perspective view of a transmission unit of the embodiment.

Referring to FIGS. 1 and 4, the transmission unit 40 includes a first fixed pulley set 41, two second fixed pulley sets 42, two third fixed pulley sets 43, a first movable pulley 44, a moveable pulley set 45, two second movable pulleys 46, a first cable 47, two second cables 48, and a third cable 49. The first fixed pulley set 41 and the two second fixed pulley sets 42 are mounted on the support unit 12; while the two third fixed pulley sets 43 are mounted on the base seat 11. The first movable pulley 44 is disposed above the base seat 11 and is proximate to the support unit 12. The movable pulley set 45 is disposed at a side of the first movable pulley 44, and the two second movable pulleys 46 are disposed respectively at opposite sides of the first movable pulley 44. The first cable 47 wraps around the first fixed pulley set 41, the first movable pulley 44 and the movable pulley set 45. The two second cables 48 each wrapping around a respective one of the second movable pulleys 46 and a respective one of the second fixed pulley sets 42. The third cable 49 wraps around the third fixed pulley set 43 and the movable pulley set 45, and is connected to the second movable pulleys 46. The first fixed pulley set 41 of the transmission unit 40 includes a plurality of first fixed pulleys 411 that are mounted to the front frame member 122, the rear frame member 121, and the hanging member 123. Each of the second fixed pulley sets 42 of the transmission unit 40 includes a plurality of second fixed pulleys 421 that are mounted to a respective one of the lower mounting rods 124 and a respective one of opposite lateral ends of the upper mounting rod 125. Each of the third fixed pulley set 43 includes a plurality of third fixed pulleys 431 mounted on the base seat 11. The movable pulley set 45 of the transmission unit 40 includes a block 451, an upper movable pulley 452 fixed on the block 451, and a lower movable pulley 453 fixed on the block 452 and disposed under the upper movable pulley 452. The first cable 47 also wraps around the upper movable pulley 452, and the third cable 49 wraps around the lower movable pulley 453.

The operating unit 50 includes at least one operating member that is connected to one of the first and second cables 47, 48. In this embodiment, the operating unit 50 includes a plurality of operating members that are configured as two hand grips 51, a long handlebar 52, or a short handlebar 53. However, this is not a limitation of the disclosure. The two hand grips 51 are respectively detachably connected to the second cables 48. The long handlebar 52 is detachably connected to a first end of the first cable 47, and the short handlebar 53 is detachably connected to a second end of the first cable 47.

Referring to FIG. 1, when a user wishes to begin using the fitness exercise apparatus, the inner leg member 21 is first coupled to the retaining members 113, and the seat member 24 may be selected, according to the type of training the user wishes to perform, to either slide against or be securely affixed to the guide rail 23 via the latch unit 26. The number of elastic strips 324 may also be selected according to the type of training the user wishes to engage in, and the two opposite ends of each elastic strip 324 are respectively connected to the upper hanger 321 and the lower hanger 322 on a same side of the two guide rods 126. Then the adjusting pin 314 (see FIG. 5) is inserted into a selected one of the weight plates 313 and a corresponding pin hole 315 of the adjusting rod 312.

Figure 8:
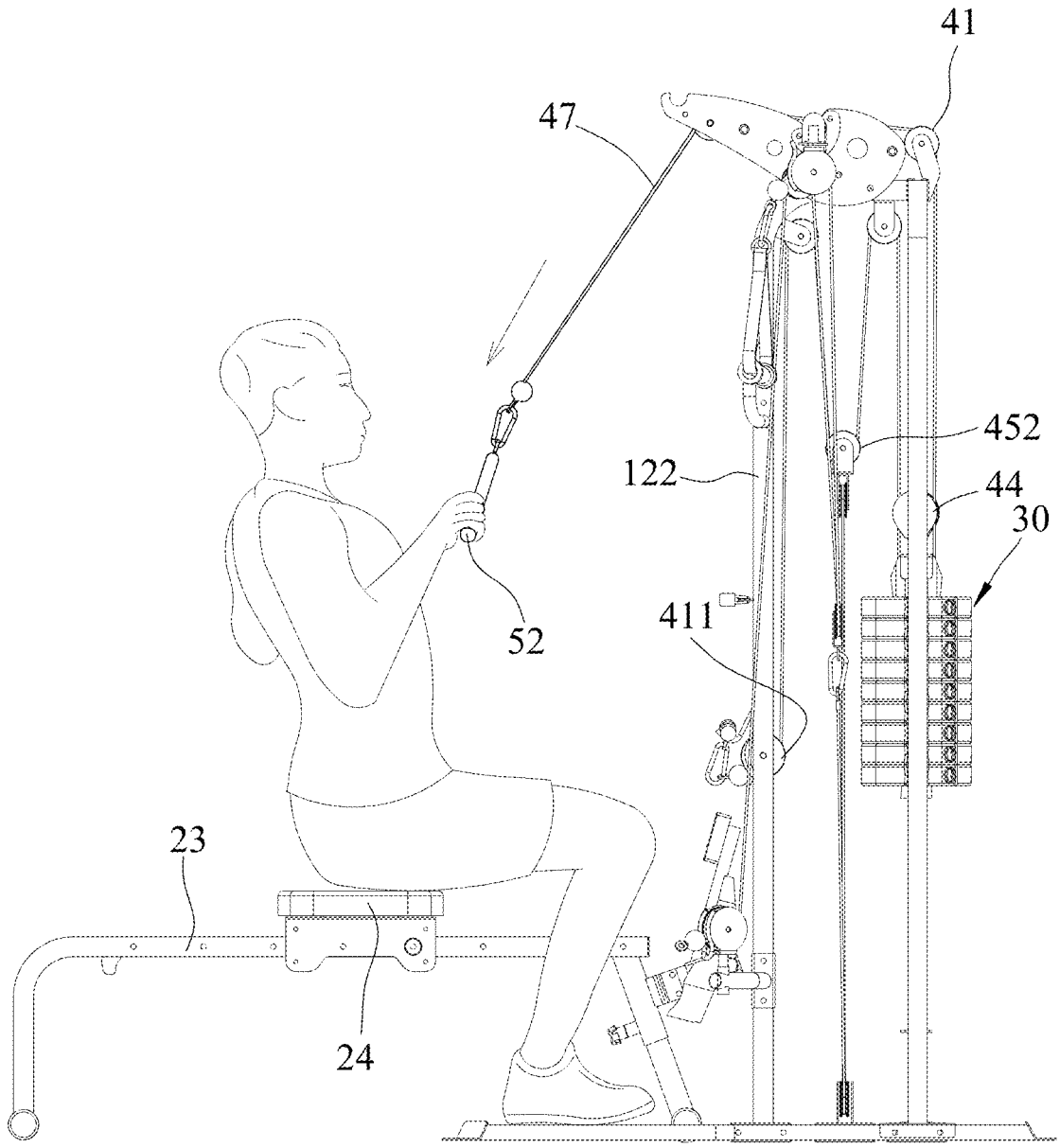
FIG. 8 is a schematic side view showing the embodiment used in a wide grip lat pulldown exercise by a user.

Referring to FIGS. 7 and 8, when the seat member 24 is securely affixed relative to the guide rail 23 and the user is seated on the seat member 24, the user may exert a pulling movement by pulling the long handlebar 52 downwards. The pulling of the first cable 47 drives the movable pulley 44 to move upwardly, thereby resulting in upward movement of the weight subunit 31 against an elastic force of the elastic subunit 32. In this case, the first fixed pulley set 41 and the upper movable pulley 452 guide the first cable 47, and second end of the first cable 47 is fixed by the front frame member 122 to prevent movement, so that when the when the long handlebar 52 is pulled by the user, the first movable pulley 44 and the weight subunit 31 will be moved upwards. The above setup allows the user to perform a wide grip lat pulldown exercise as shown in FIG. 8, where the user is shown seated facing the fitness exercise apparatus. The user may vary the resistance of the exercise by inserting the adjusting pin 314 in a different weight plate 313 via a corresponding pin hole 315 of the adjusting rod 312 and/or by changing the number and/or resistance of the elastic strips 324. The same set up also allows the user to perform a wide grip rear pulldown exercise (not shown in the Figures) by sitting in a reverse position with their back facing the fitness exercise apparatus. The advantages of the fitness exercise apparatus according to the disclosure is that the exercises may be performed aerobically as well as anaerobically. More specifically, when the weight blocks 313 of the weight subunit 31 are moved upwardly to a highest position and begins descending downwards the weight blocks 313 are accelerated by the force of gravity as wells as a restoring force of the elastic strips 324, which results in increased acceleration and speed of return that allows the user to perform quicker repetitions and exercises aerobically.

Figure 9:
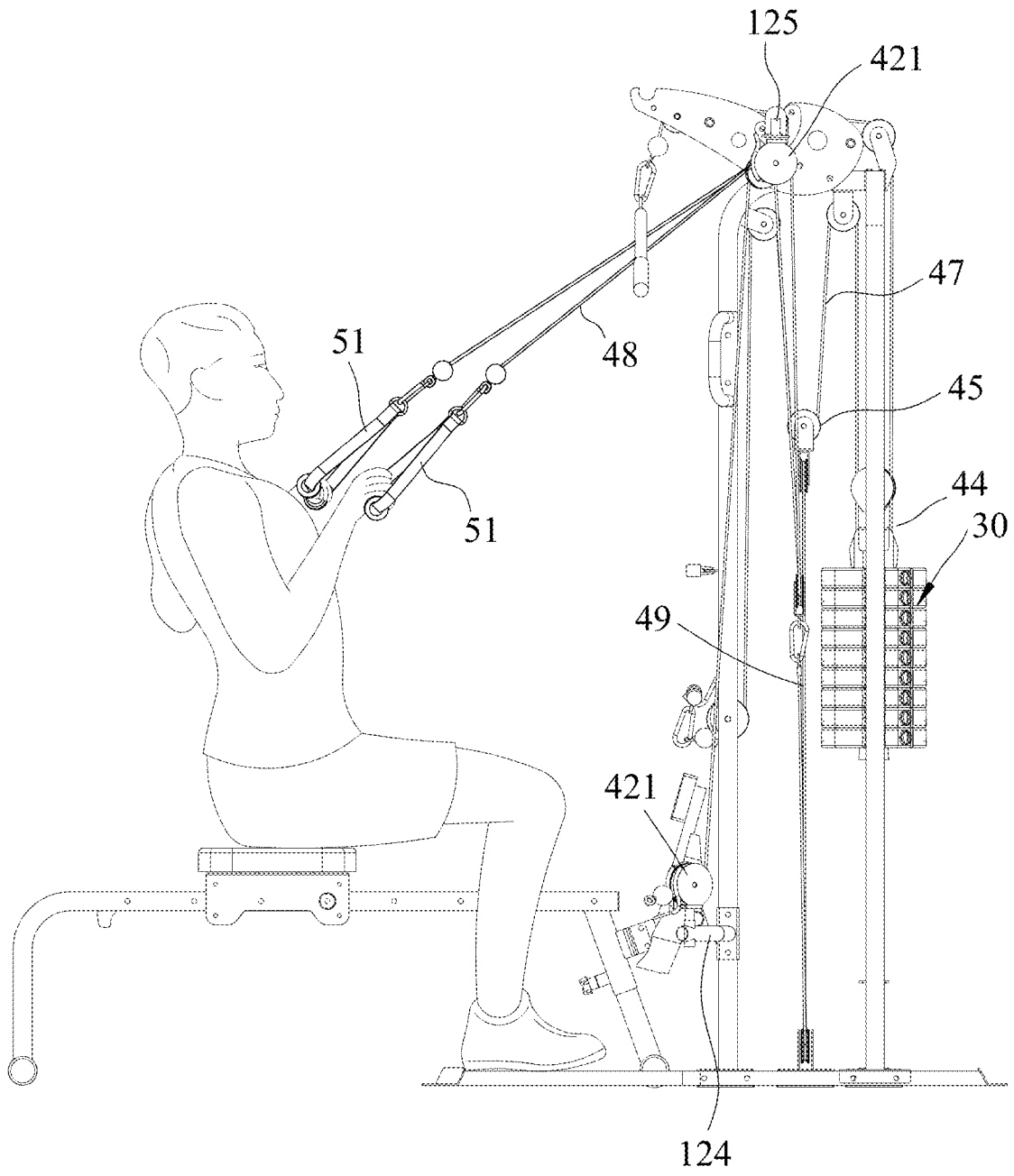
FIG. 9 is a schematic side view showing the user performing a chest pull exercise on the embodiment.

Referring to FIG. 9, the user is shown performing a chest pull exercise on the fitness exercise apparatus. In this case, referring further to FIGS. 1 and 4, the fitness exercise apparatus is set up by connecting the two hand grips 51 respectively to the first ends of the two second cables 48 with the second ends of the second cables 48 being fixed. The user may then perform a pulling motion on the two hand grips 51 which pulls the two second cables 48. The pulling of the second cables 48 drives the second movable pulleys 46 to move upwardly, thereby pulling the first cable 47 via the third cable 49 and the movable pulley set 45, and eventually resulting in upward movement of the weight subunit 31 and the first movable pulley 44 against the elastic force of the elastic subunit 32. Additionally, it should be noted that a seated straight arm pulldown exercise (not shown in the Figures) may be performed from the same setup of the fitness exercise apparatus as described above.

Figure 10:
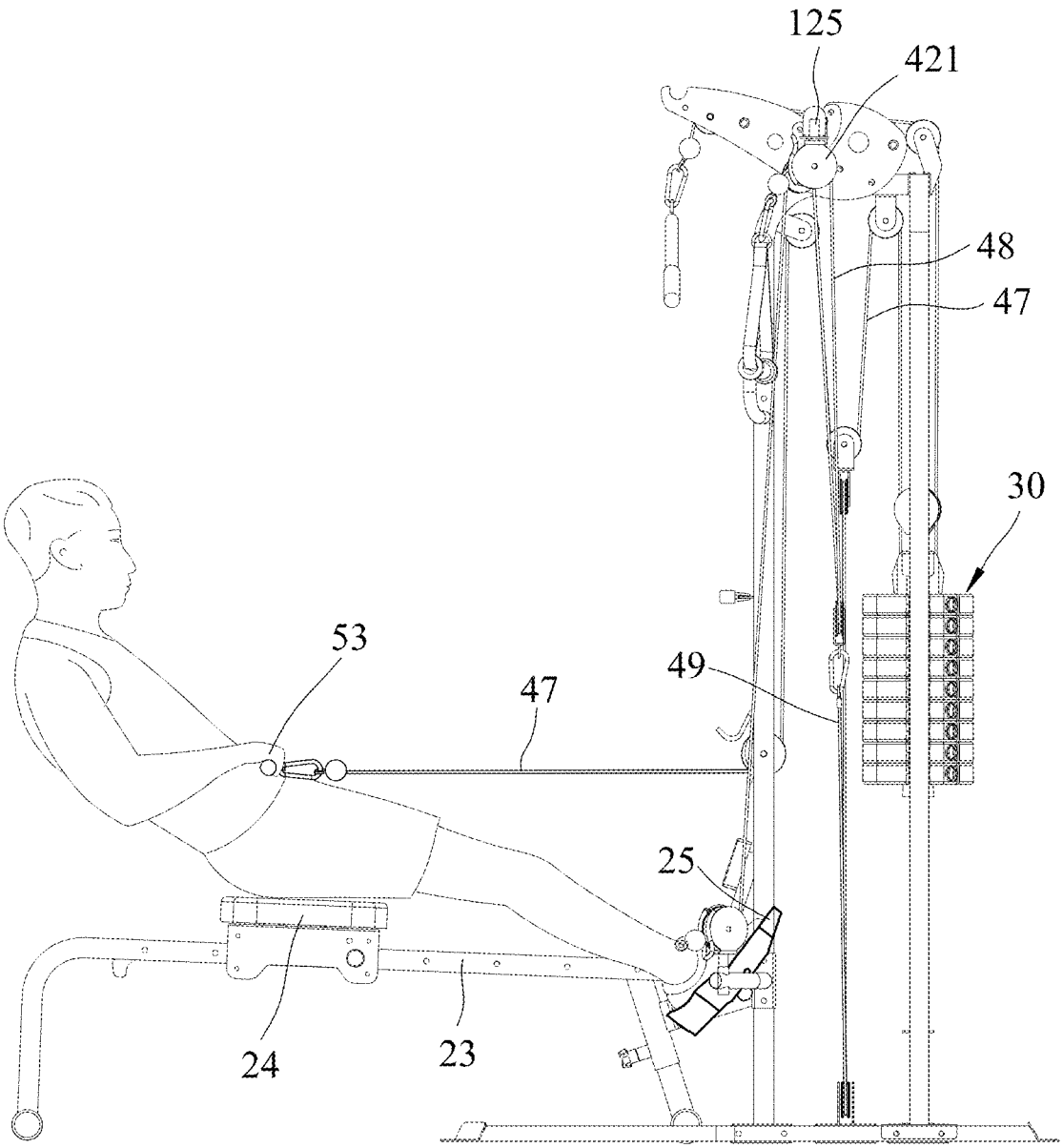
FIG. 10 is a schematic side view showing the user performing a seated cable row exercise on the embodiment.

Referring to FIG. 10, a seated cable row exercise may be performed on the fitness exercise apparatus. In this case, the fitness exercise apparatus is set up by operating the latch unit 26 so that the seat member 24 is capable of sliding relative to the guide rail 23. The user is seated on the seat member 24 and has both feet planted on the foot rests 25. The short handlebar 53, which is connected to the second end of the first cable 47, is used in this exercise. The user pulls the short handlebar 53 while seated on the seat member 24 and sliding relative to the guide rail 23. The first end of the first cable 47 is fixed to prevent movement, so that resistance against the user's pull from the resistance unit 30 can be transferred via the first cable 47. The seated cable row exercise allows the user to effectively train the latissimus dorsi muscles and the trapezius muscles.

Figure 11:
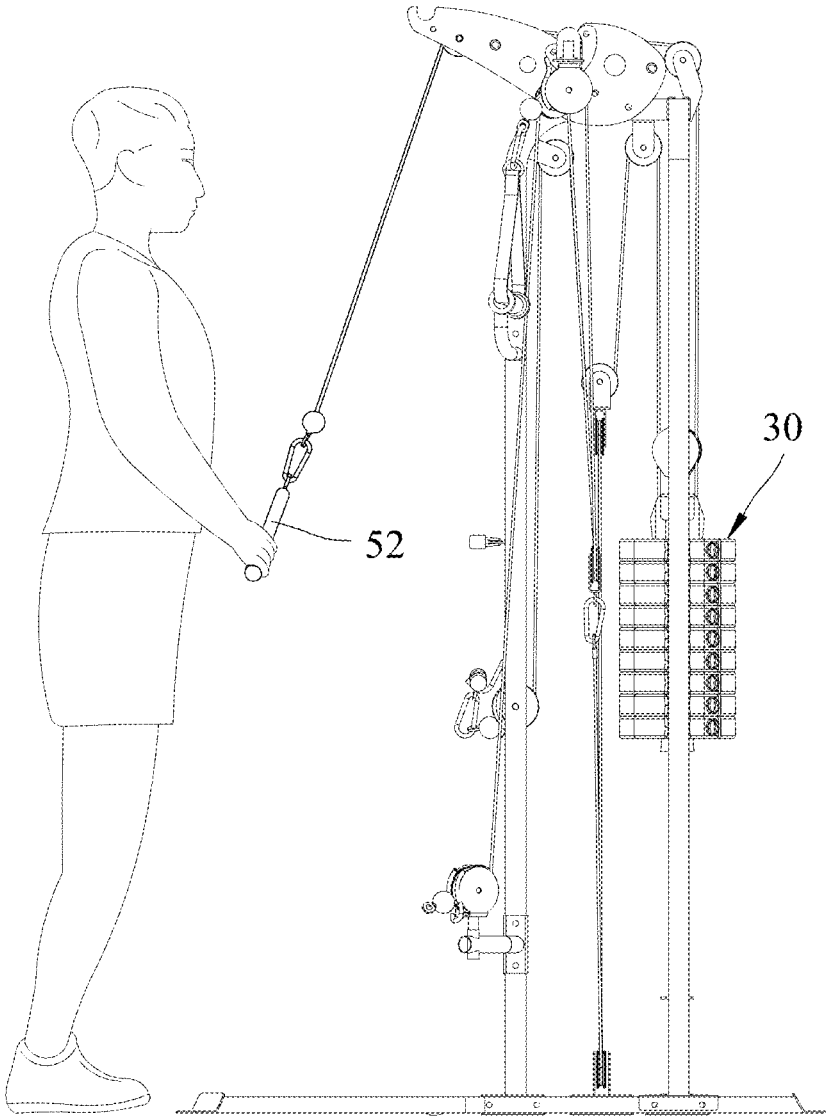
FIG. 11 is a schematic side view showing the user performing a triceps push down exercise on the embodiment.

Referring to FIG. 11, the seat unit 20 may be detached from the main frame 10 to allow the user to perform a triceps push down exercise. In this case, the user is standing and uses the long handlebar 52 to pull down against the resistance of the resistance unit 30. The setup is similar to the wide grip lat pulldown exercise shown in FIG. 8 and further details are omitted for the sake of brevity.

Figure 12:
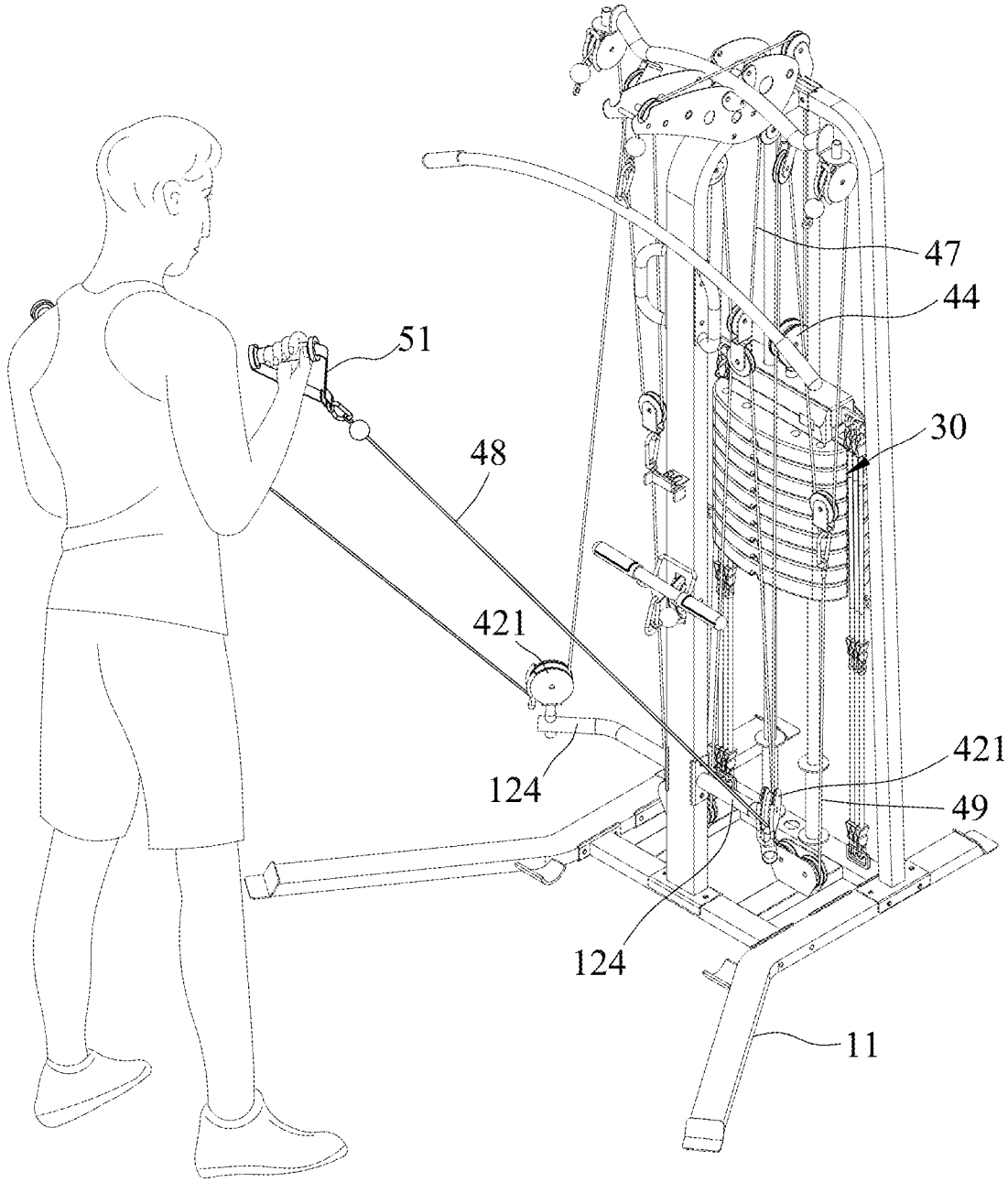
FIG. 12 is a schematic perspective view illustrating the user performing a standing low pulley bicep curl exercise on the embodiment.

Referring to FIG. 12, the user is shown performing a standing low pulley bicep curl. In this case, the seat unit 20 is detached from the main frame 10 and the user stands in the middle of the spaced-apart legs 111 of the base seat 11. The two hand grips 51 are connected respectively to the second ends of the two second cables 48 with the first ends of the second cables 48 being fixed. The user exerts a pulling motion that pulls the second cables 48. The pulling of the second cables 48 will drive the second movable pulleys 46 to move upwardly, thereby pulling the first cable 47 via the third cable 49 and the movable pulley set 45, and eventually the weight subunit 31 and the first movable pulley 44 will be pulled upward. The resistance unit 30 provides resistance against the user's pulling motion.

Figure 13:
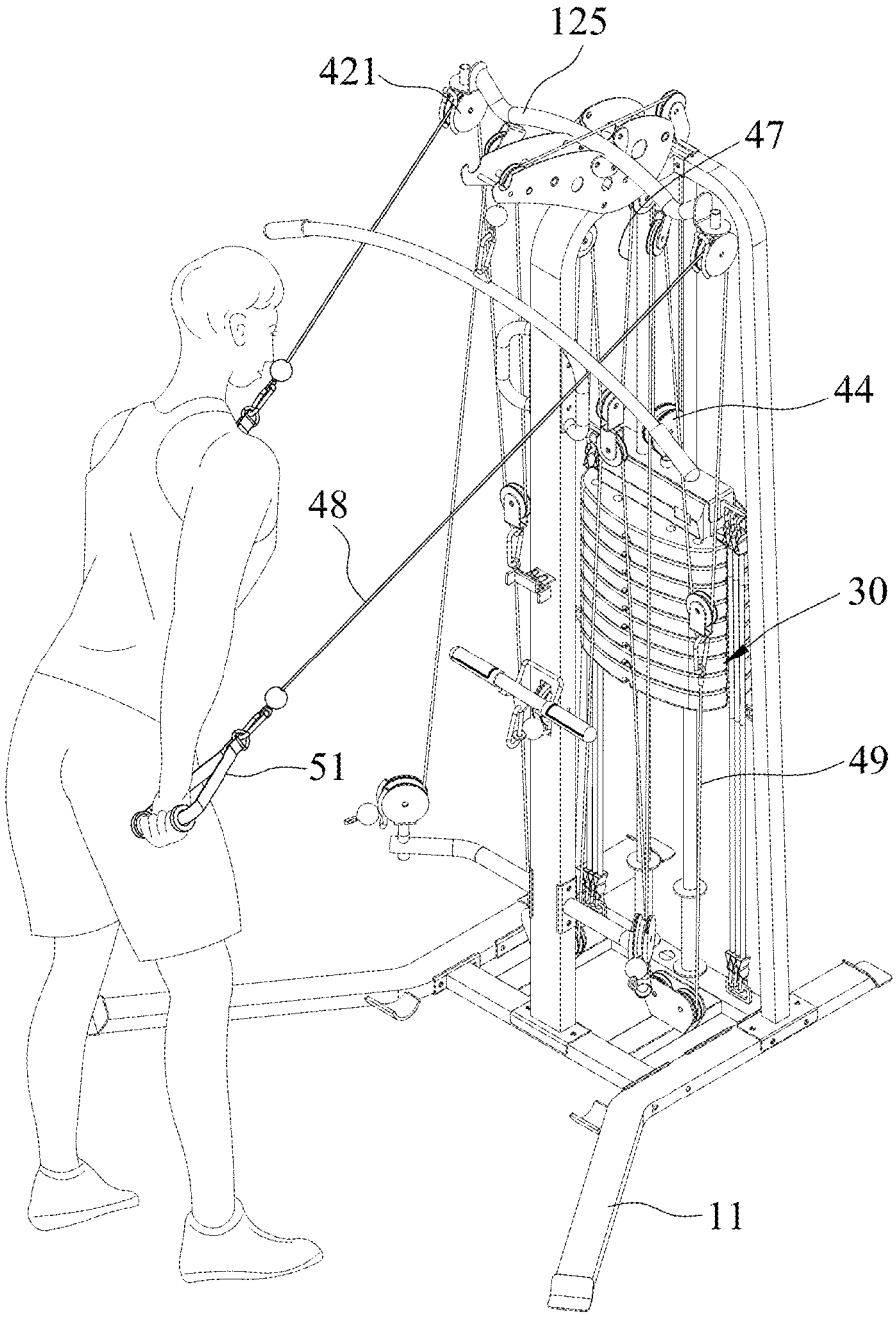
FIG. 13 is a schematic perspective view illustrating the user performing an alternating straight arm pull down exercise on the embodiment.

Referring to FIG. 13, the user is shown performing an alternating straight arm pulldown exercise. For this exercise the fitness exercise apparatus is set up by detaching the seat unit 24 from the main frame 10, and then respectively connecting the two hand grips 51 to the first ends of the two second cables 48 with the second ends of the second cables 48 being fixed. The user performs a pulling motion with the two hand grips 51 by pulling the two second cables 48. The pulling of the second cables 48 will drive the second movable pulleys 46 to move upwardly, thereby pulling the first cable 47 via the third cable 49 and the moveable pulley set 45, and eventually resulting in upward movement of the weight subunit 31 and the first movable pulley 44 against the elastic force of the elastic subunit 32. Additionally, it should be noted that a standing straight arm pulldown exercise may be performed from the same setup of the fitness exercise apparatus.

Figure 14:
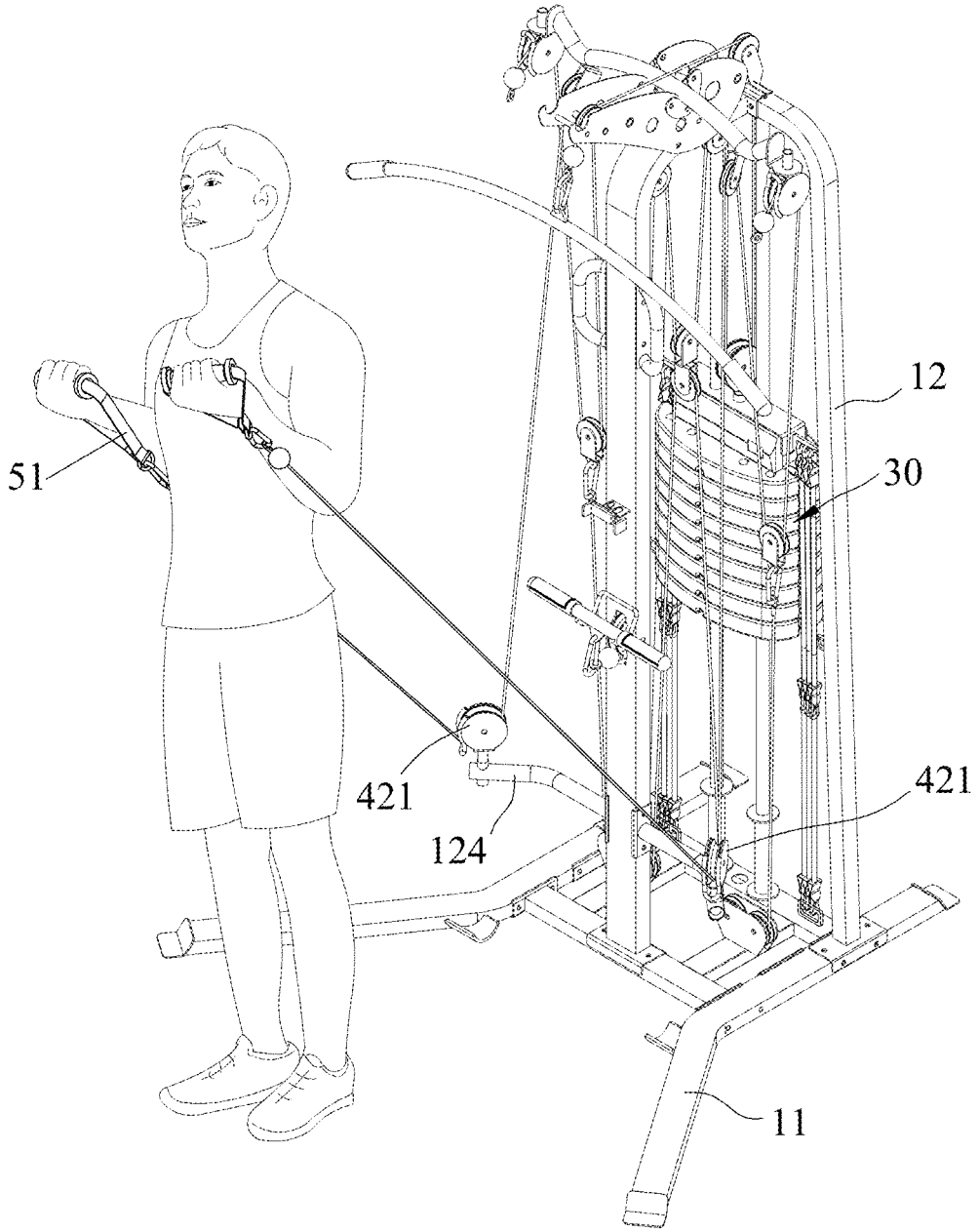
FIG. 14 is a schematic perspective view illustrating the user performing a reverse standing low pulley bicep curl exercise on the embodiment.

Referring to FIG. 14, in this setup the user is standing with their back facing the fitness exercise apparatus and performing a reverse low pulley standing bicep curl exercise. The two hand grips 51 are connected respectively to the second ends of the two second cables 48 with the first ends of the second cables 48 being fixed.

Figure 15:
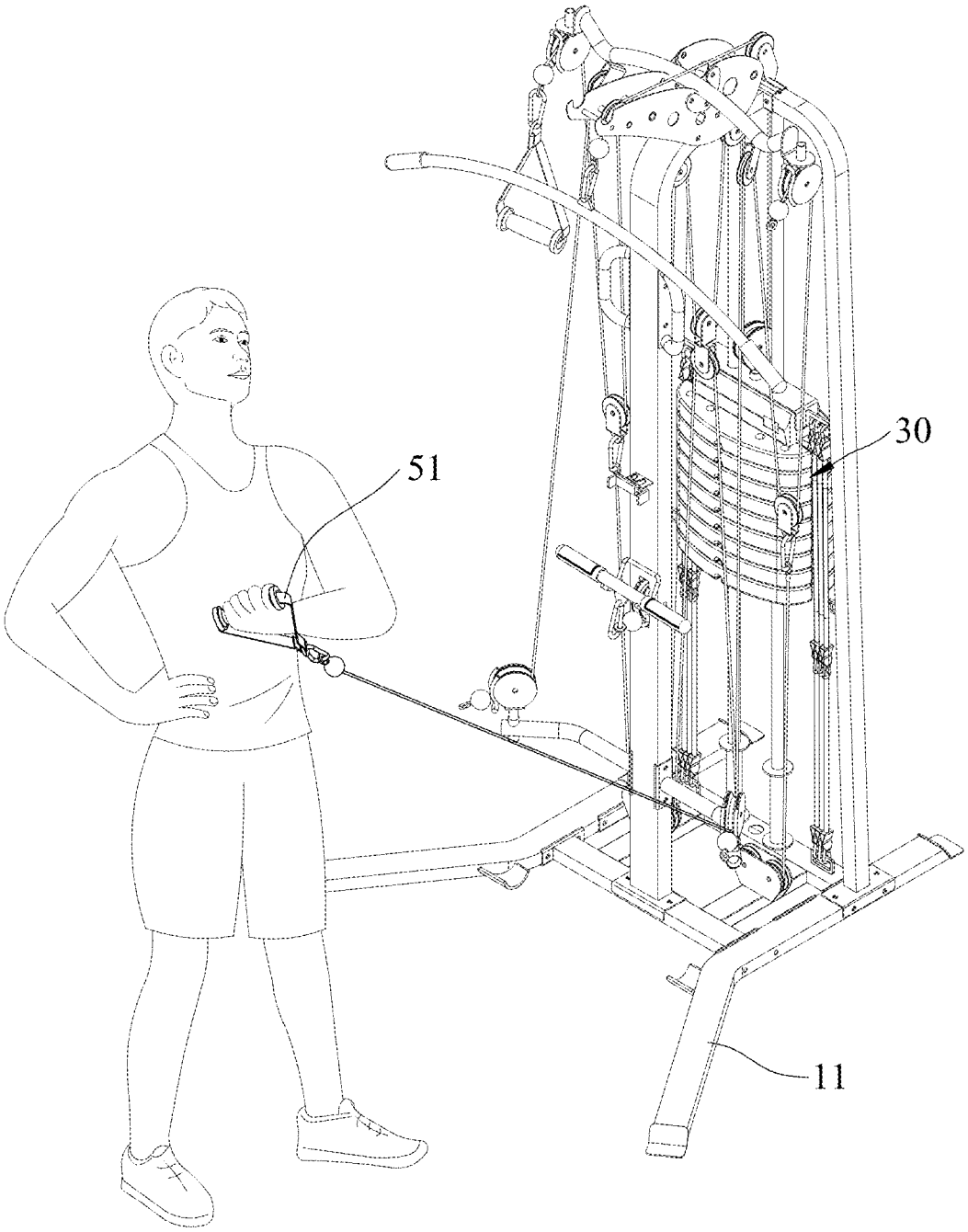
FIG. 15 is a schematic perspective view showing the user performing a cross body bicep curl exercise on the embodiment.

Referring to FIG. 15, the user is shown performing a cross body bicep curl exercise. The user stands sideways relative to the main frame 10 of the fitness exercise apparatus and performs a pulling motion using only a single hand grip 51 that is connected to the second end of one of the second cables 48.

Figure 16:
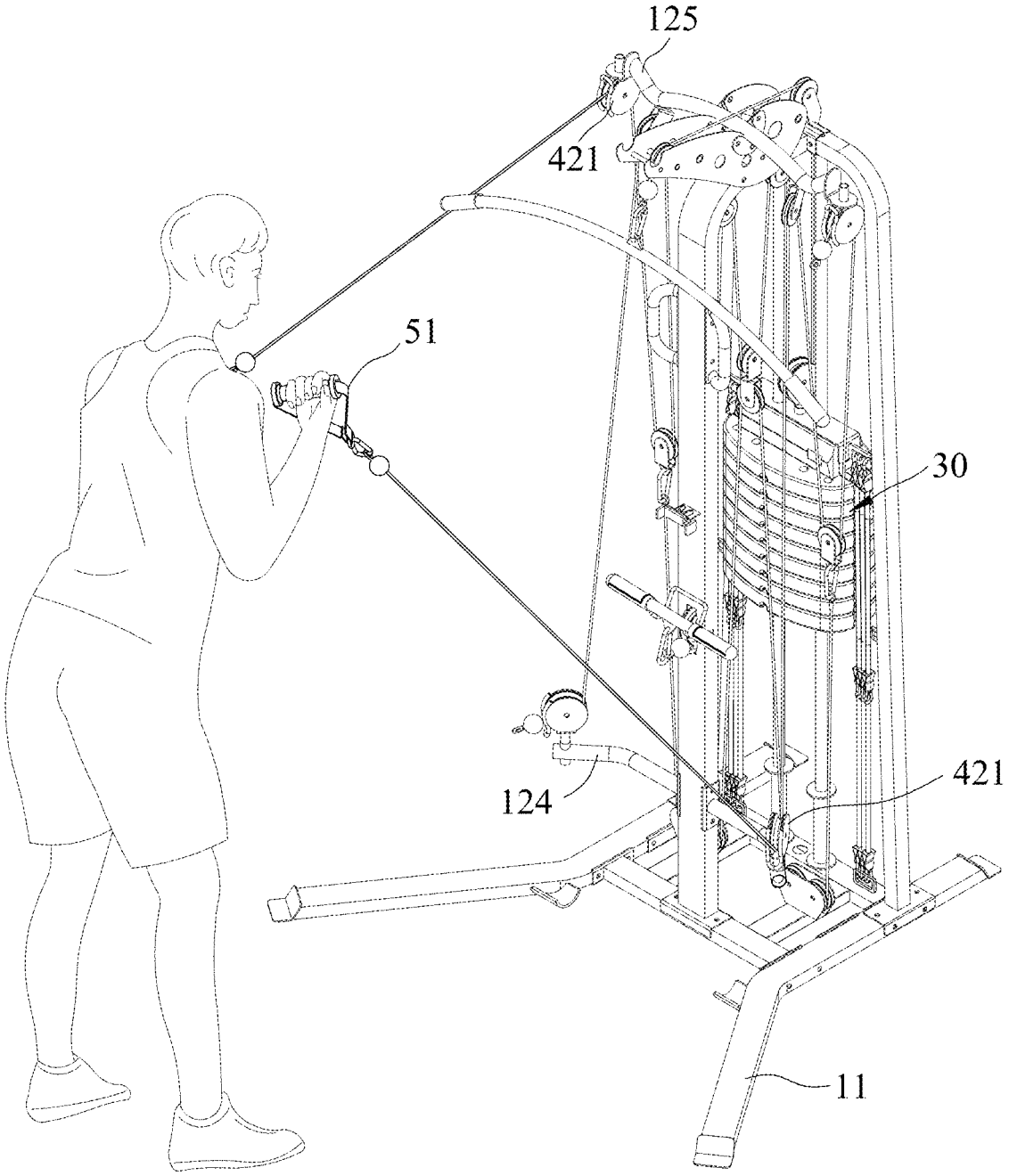
FIG. 16 is a schematic perspective view showing the user performing a standing high and cable crossover exercise on the embodiment.

Referring to FIG. 16, the user is shown performing a standing high and low cable crossover exercise, where the user pulls the two hand grips 51 from a higher angle and a lower angle, to crossover at chest height. For this exercise one of the two hand grips 51 is connected to the first end of one of the second cables 48, and the other one of the two hand grips 51 is connected to the second end of the other one of the second cables 48.

Figure 17:
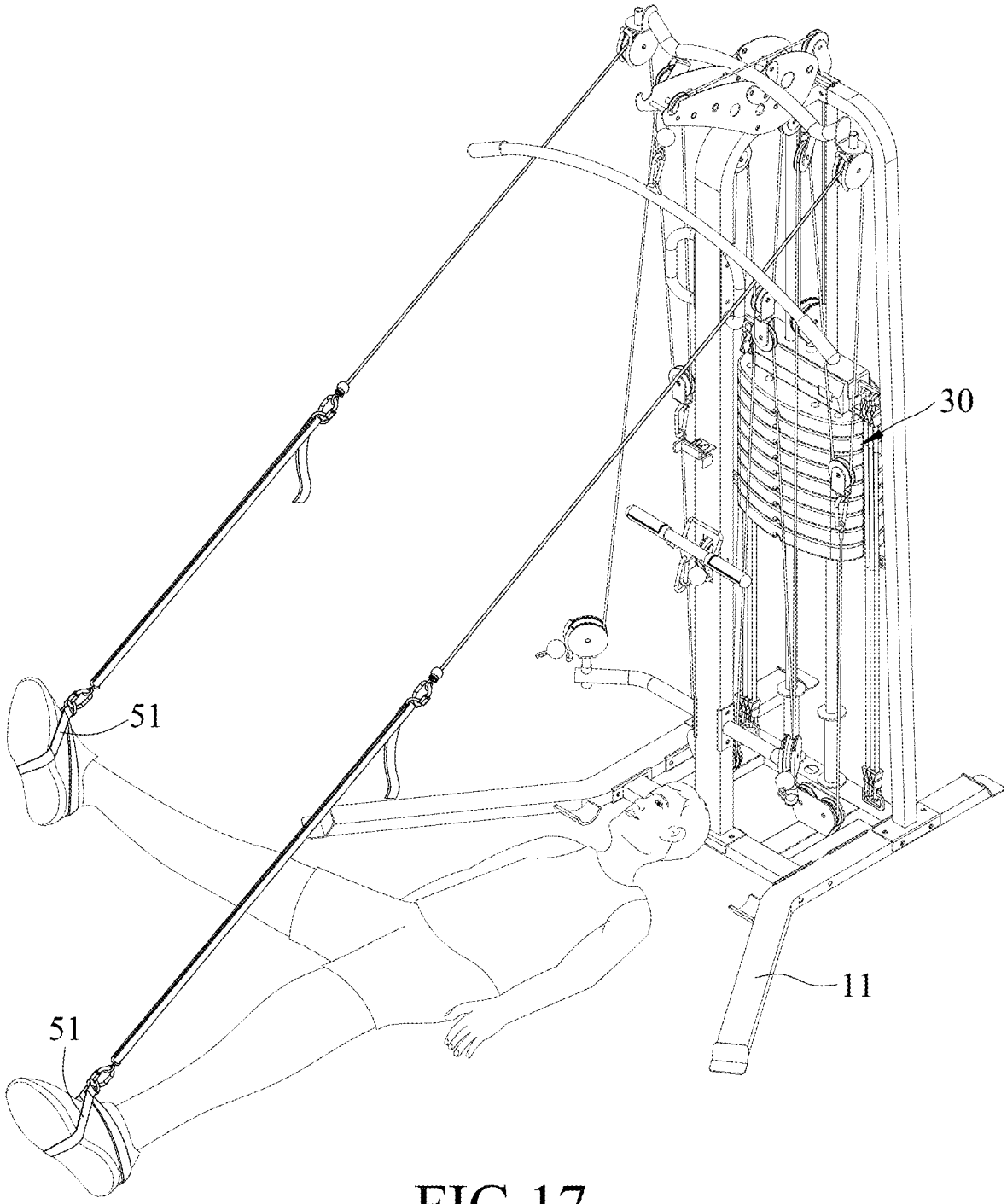
FIG. 17 is a schematic perspective view showing the user performing an alternating leg drop exercise on the embodiment.

Referring to FIG. 17, the user is showing performing an alternating leg drop exercise. For this exercise, the fitness exercise apparatus is setup the same as for the chest pull exercise, and the user uses the hand grips 51 as foot straps.

Figure 18:
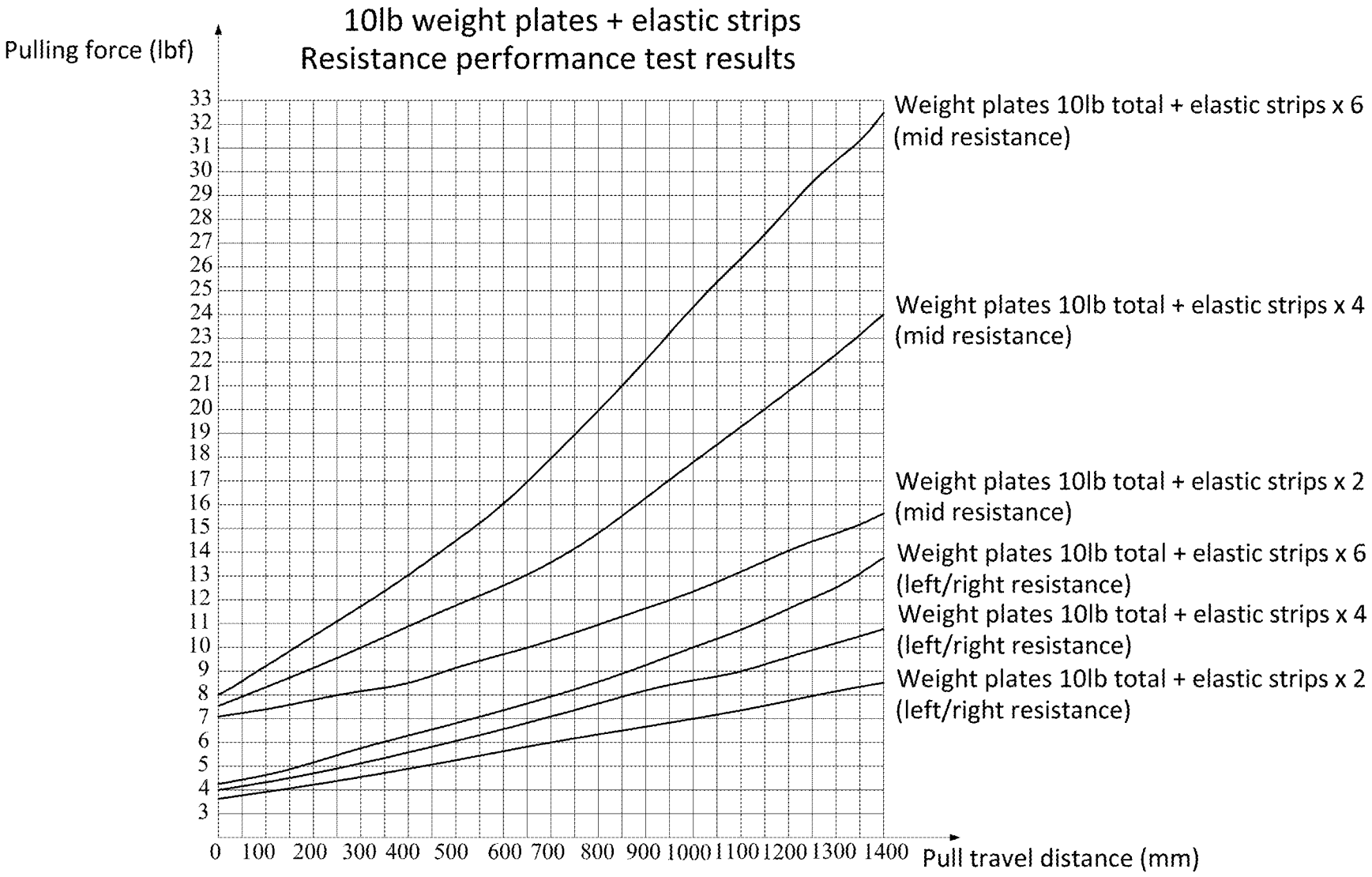
FIG. 18 is a force distance graph of 10 lb test results from exercises performed with the fitness exercise apparatus.
Figure 19:
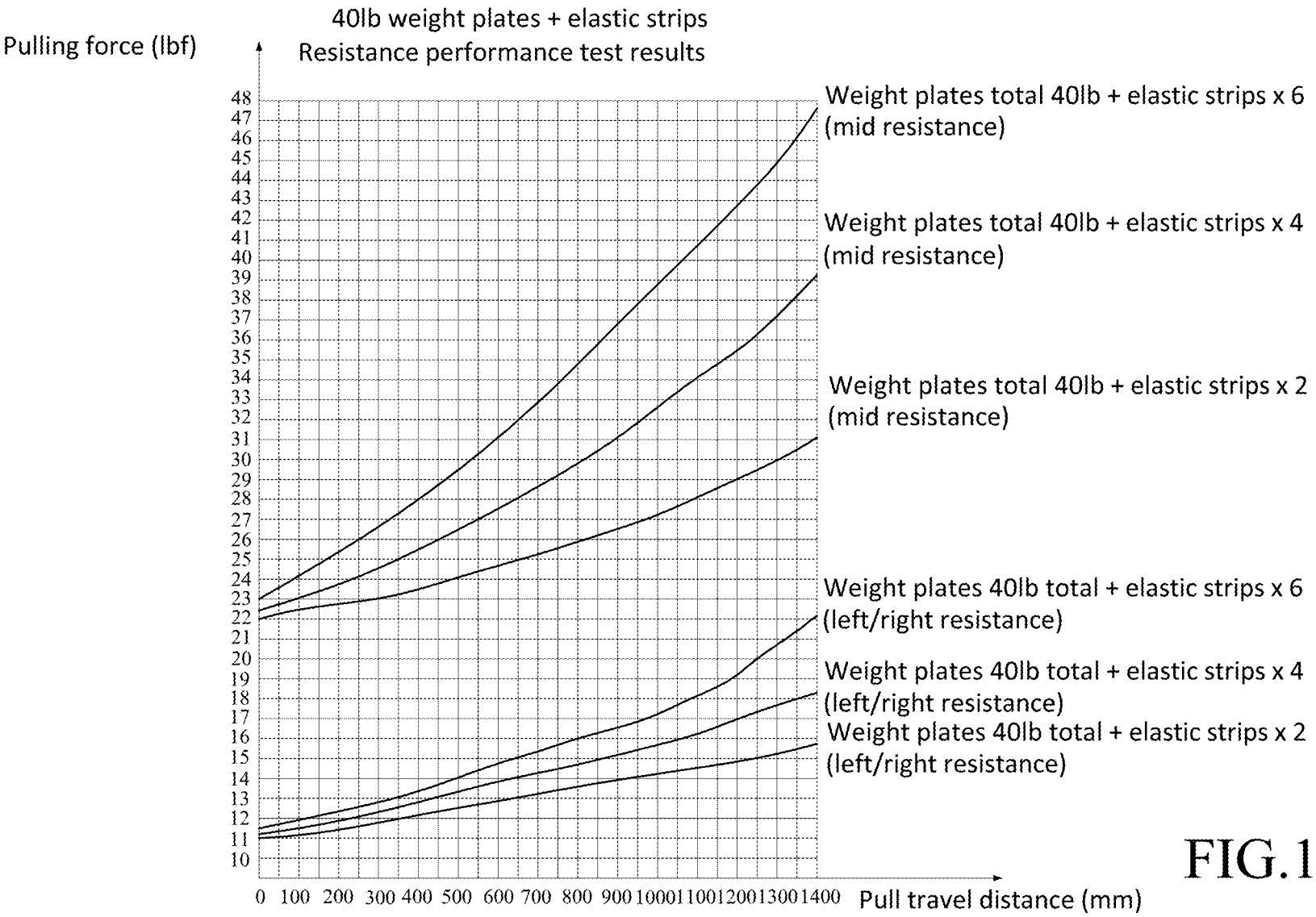
FIG. 19 is a force distance graph of 40 lb test results from exercises performed with the fitness exercise apparatus.
Figure 20:
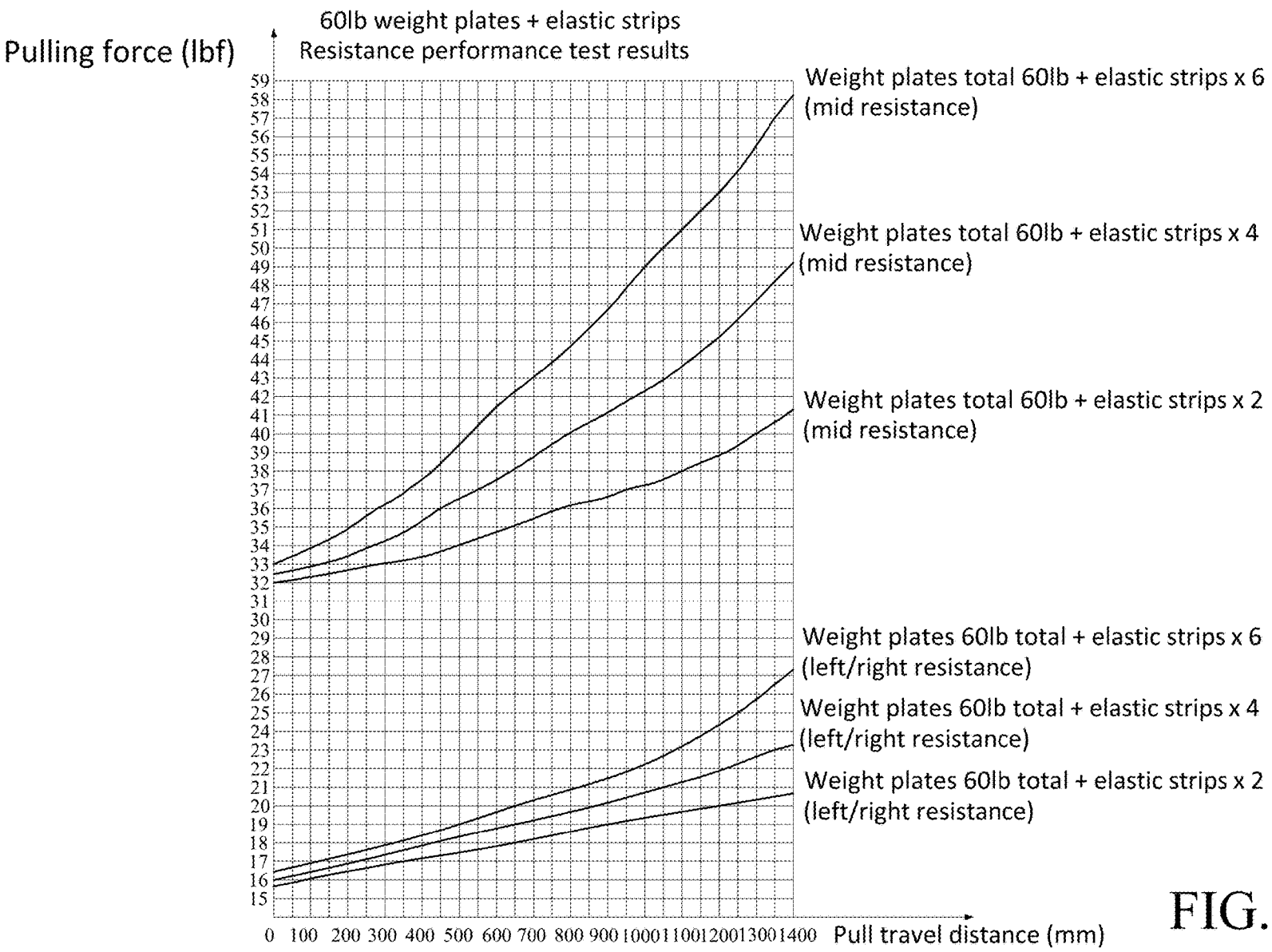
FIG. 20 is a force distance graph of 60 lb test results from exercises performed with the fitness exercise apparatus.

The fitness exercise apparatus according to the present disclosure has the following advantages:

1. The fitness exercise apparatus is a multi-functional exercise machine that combines the functionality of a detachable rowing bench with a cable machine by designing the seat unit 20 to be detachable. Additionally, the fitness exercise apparatus is functional for strength training and body building as well as for aerobic exercises and cardio workouts, and is therefore a truly multi-functional cardio & strength gym equipment. Furthermore, when the weight blocks 313 of the weight subunit 31 are moved upwardly to a highest position and begins descending downwards, the weight blocks 313 are accelerated by the force of gravity as wells as a restoring force of the elastic strips 324, which results in increased acceleration and speed of return so that the user may increase the repetition rate of their exercise and perform the exercise aerobically. Further still, by having the elastic sets 323 of the elastic subunit 32 disposed respectively at opposite sides of the weight subunit 31, and by having the specifications of the elastic strips 324 of the elastic sets 323 be identical, the restoring force provided by the elastic subunit 32 will be balanced and will not disrupt the movement of the weight blocks 313.
2. In addition to providing the fitness exercise apparatus with the benefits of cardio gym equipment, by having the resistance unit 30 include an elastic subunit 32 in addition to the weight subunit 31, an additional option for the user to change the resistance during their workout has been provided. Therefore, the user may fine tune the resistance of their exercise and gradually increase the intensity of their workout after warming up to prevent injury. Additionally, conventional anaerobic strength training may be enhanced with an increased repetition rate, and users may benefit from the greater range of resistance that the fitness exercise apparatus offers; especially for exercises such as the seated cable row.
3. By designing the seat unit 20 to be a detachable bench, the structure of the seat unit 20 may be streamlined to lower costs. The detachability of the seat unit 20 also has the benefit of providing easier storage for the fitness exercise apparatus. Referring to FIGS. 18 to 20, three series of tests were conducted while performing various exercises that are divided into two groups. A mid resistance group including exercises such as the wide grip lat pulldown, the seated cable row, and the triceps push down (exercises where the operating member is connected to the first cable 47); and a left/right resistance group including exercises such as the standing low pulley bicep curl, the chest pull and the alternating straight arm pulldown (exercises where the operating member is connected to the second cable 48). The exercises are performed at different resistance parameters by varying the total resistance of the weight plates 313 and the number of elastic strips 324. In the first series of tests each exercise type was performed with resistance parameters of total weight plate resistance

101*b* plus two, four and six elastic strips and the force-distance plot of the test results are shown in FIG. 18. In the second series of tests each exercise type was performed with resistance parameters of total weight plate resistance 401*b* plus two, four and six elastic strips and the force-distance plot of the test results are shown in FIG. 19. In the third series of tests each exercise type was performed with resistance parameters of total weight plate resistance 601*b* plus two, four and six elastic strips and the force-distance plot of the test results are shown in FIG. 20. The above tests show the exerted force at different travel distances for different exercises and resistance combinations and is useful data for users of the fitness exercise apparatus to plan their training.

Figure 21:
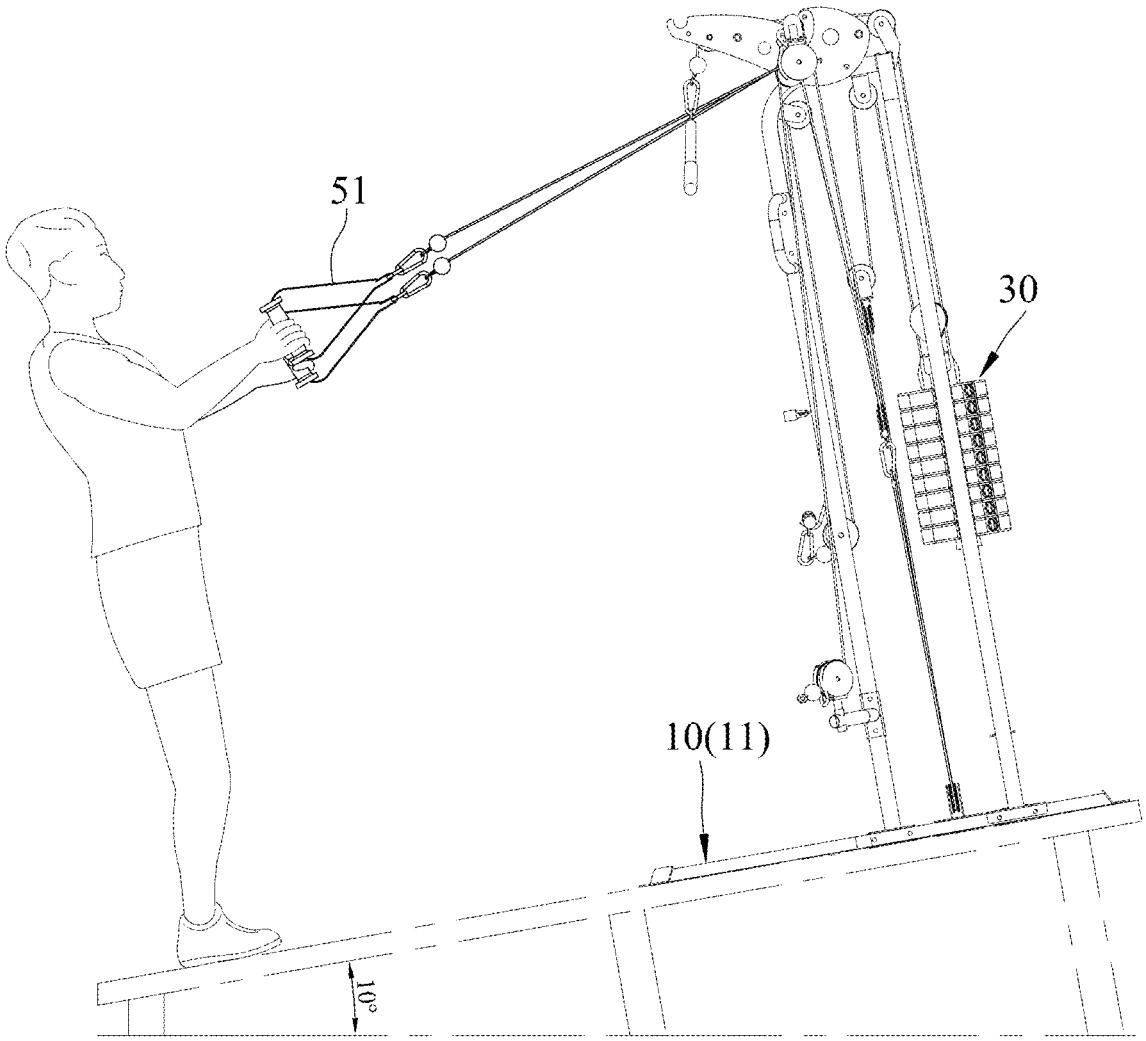
FIG. 21 is a schematic side view illustrating the user using the embodiment at an inclined angle.
Figure 22:
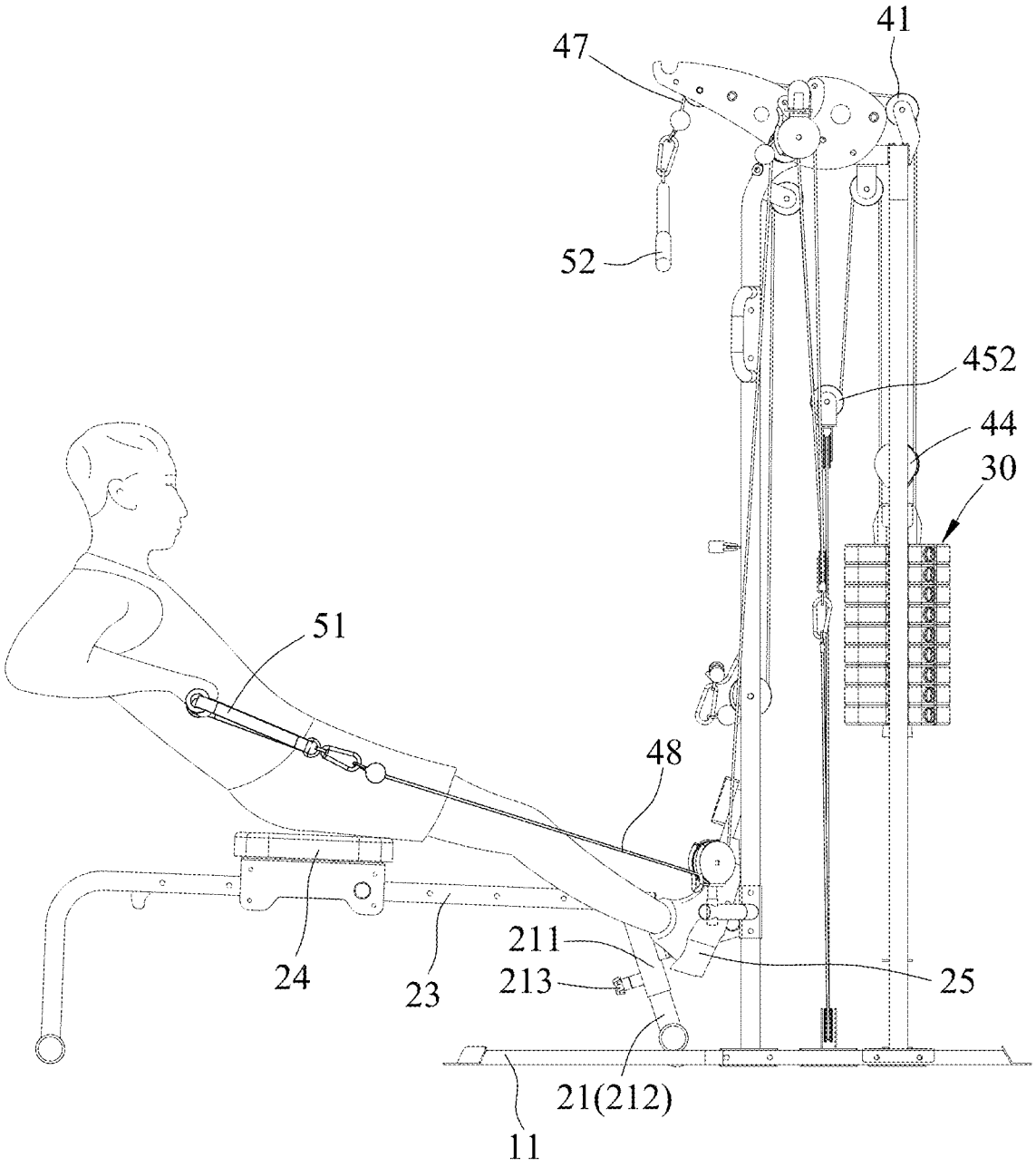
FIG. 22 is a schematic side view illustrating the user using the embodiment at a declined angle.

4. Referring to FIGS. 1 and 21, the base seat 11 of the main frame has a flared design so that the fitness exercise apparatus is more stable. The fitness exercise apparatus will comply with European standards EN957-2 test methods for stationary training equipment under test conditions of an incline of 10°, a load of 100 lb and six elastic strips 324.
5. FIG. 22 shows the fitness exercise apparatus used in a manner similar to a two handle rowing machine by a user. The fitness exercise apparatus has the advantage in that it can be used for two styles of indoor rowing exercises. Additionally, the length of the inner leg member 21 of the seat unit 20 is adjustable so that the angle of the guide rail 23 may easily adjusted to be flat, inclined or declined. When the guide rail 23 is adjusted to be flat, the fitness exercise apparatus is suitable for bench training, and the guide rail 23 may be adjusted to be inclined to increase resistance for indoor rowing. Moreover, the seat unit 20 may be detached and removed in exercises where the user needs to stand right next to the fitness exercise apparatus.
6. By designing the seat unit 20 to be detachable, the fitness exercise apparatus is easier to manufacture, while also lowering the cost of manufacture. The detachable seat unit 20 is easier to package and ship, and can achieve 50% more shipping container utilization, which may translate to huge cost savings during periods of high inflation and high shipping costs.
7. The seat unit 20 is mounted to the base seat 11 through its sheer weight without complicated mechanisms of attachment, which simplifies removal, storage and operation of the fitness exercise apparatus.
8. The seat member 24 is adjustable by the latch unit 26 engaging different securing holes 231 on the guide rail 23. This allows the fitness exercise apparatus to accommodate the requirements of different users ergonomically.

Figure 23:
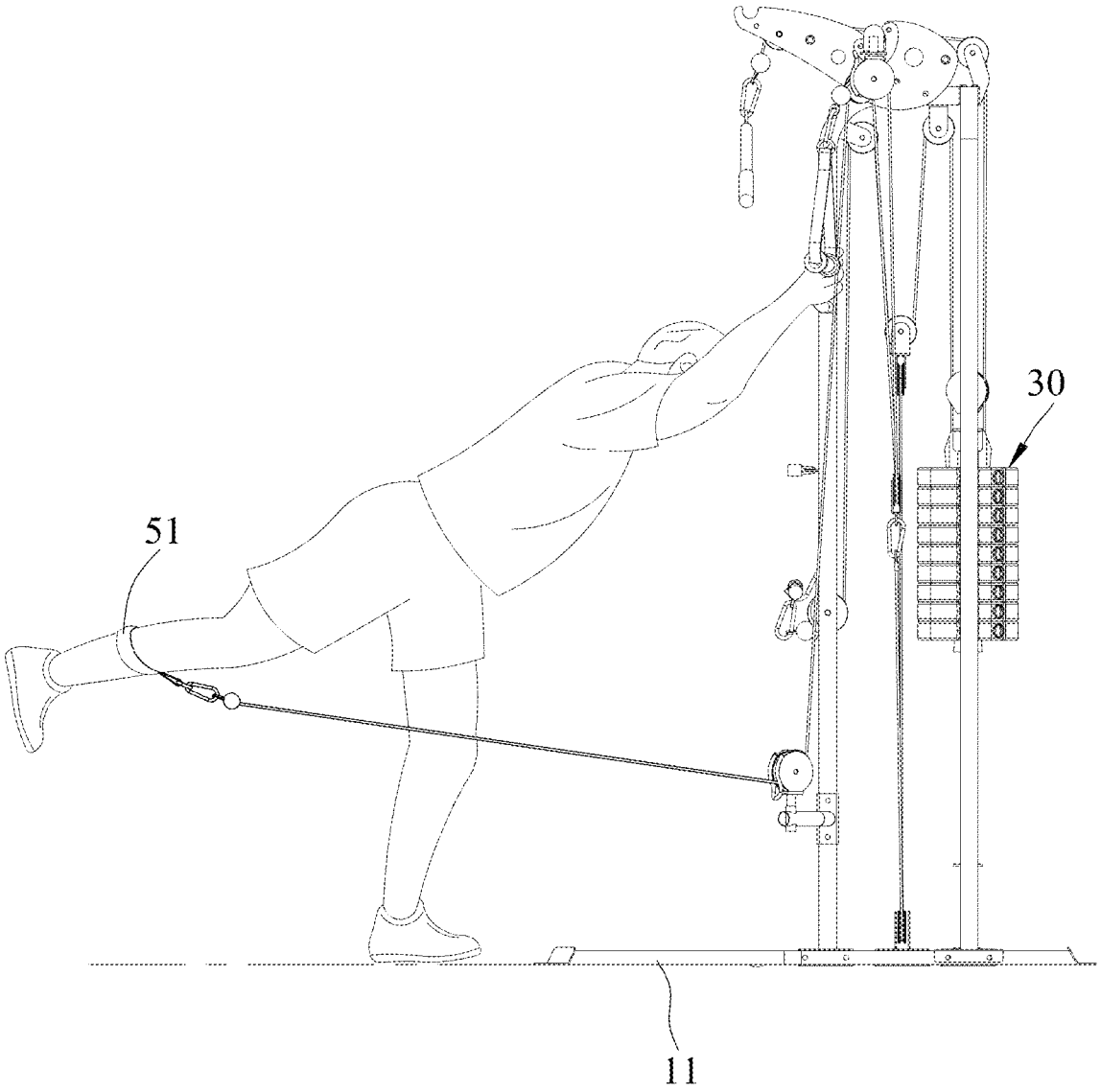
FIG. 23 is a schematic side view illustrating the user performing a cable glute kickback exercise on the embodiment.
Figure 24:
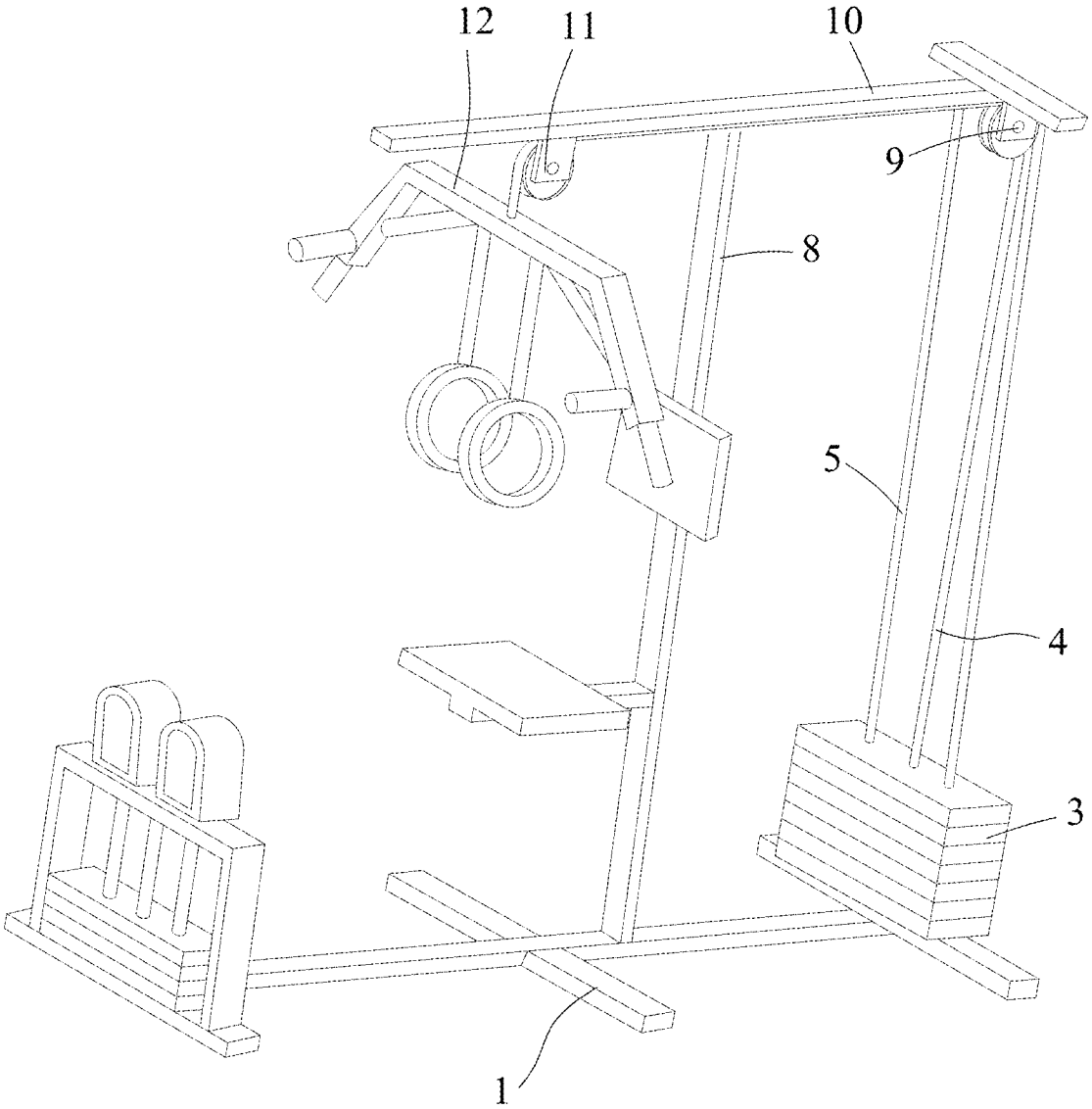
FIG.24 PRIOR ART
FIG. 24 is a perspective view of a conventional exercise machine.

Referring to FIG. 1, a conventional rowing machine display and sensor 61 is installed on the seat unit 20, a phone holder 62 is installed on the support unit 12, and sensors 521, 531 are installed respectively on the long handlebar 52 and the short handlebar 53. These instruments allow the fitness exercise apparatus to display various exercise data such as laps/repetitions, speed, calorie expenditure, and heart rate so that the user may monitor their training progress and measure their progress quantitatively. This may increase user motivation and incentivize the user to accomplish their fitness goals. The user may monitor their calorie expenditure and their heart rate from the conventional rowing machine display and sensor 61. Referring to FIG. 23, the user is shown performing a cable glute kickback exercise where the support handle 127 may be used for support and the operating member may be an ankle strap.

In summary of the above, the fitness exercise apparatus according to the disclosure has the functions of both cardio and strength training exercise machines. The structure is simple, and the manufacture process may be streamlined. The fitness exercise apparatus allows users to quickly reach their strength training as well as cardio fitness goals.

In the description above, for the purposes of explanation, numerous specific details have been set forth in order to provide a thorough understanding of the embodiment(s). It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects; such does not mean that every one of these features needs to be practiced with the presence of all the other features. In other words, in any described embodiment, when implementation of one or more features or specific details does not affect implementation of another one or more features or specific details, said one or more features may be singled out and practiced alone without said another one or more features or specific details. It should be further noted that one or more features or specific details from one embodiment may be practiced together with one or more features or specific details from another embodiment, where appropriate, in the practice of the disclosure.

While the disclosure has been described in connection with what is(are) considered the exemplary embodiment(s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A fitness exercise apparatus comprising:

a main frame including a base seat and a support unit that is connected to said base seat;

a seat unit mounted detachably on said base seat;

a resistance unit including a weight subunit that is mounted on said main frame, and an elastic subunit that is connected between said weight subunit and said main frame;

a transmission unit including a first fixed pulley set that is mounted on said support unit, two second fixed pulley sets that are mounted on said support unit, two third fixed pulley sets that are mounted on said base seat, a first movable pulley that is disposed above said base seat and that is proximate to said support unit a movable pulley set that is disposed at a side of said first movable pulley, two second movable pulleys that are disposed respectively at opposite sides of said first movable pulley, a first cable that wraps around said first fixed pulley set, said first movable pulley and said movable pulley set, two second cables, each wrapping around a respective one of said two second movable pulleys and a respective one of said two second fixed pulley sets, and a third cable that wraps around said two third fixed pulley sets and said movable pulley set, and that is connected to said two second movable pulleys; and an operating unit including at least one operating member that is connected to one of said first and second cables;

wherein pulling of said first cable drives said first movable pulley to move upwardly, thereby resulting in movement of said weight subunit against an elastic force of said elastic subunit; and wherein pulling of said two second cables drives said two second movable pulleys to move upwardly, thereby pulling said first cable via said third cable and said movable pulley set, and eventually resulting in movement of said weight subunit against an elastic force of said elastic subunit.

2. The fitness exercise apparatus of claim 1, wherein:

said support unit of said main frame includes a rear frame member that is inverted U-shaped, a front frame member that is connected between said rear frame member and said base seat and that is inverted L-shaped, and a hanging member that is mounted on top of said front frame member; and said first fixed pulley set of said transmission unit includes a plurality of first fixed pulleys that are mounted to said front frame member, said rear frame member, and said hanging member.

3. The fitness exercise apparatus of claim 2, wherein:

said support unit of said main frame further includes two lower mounting rods that are connected respectively to opposite lateral sides of said front frame member, and an upper mounting rod that is mounted on said hanging member; and each of said two second fixed pulley sets of said transmission unit includes a plurality of second fixed pulleys that are mounted to a respective one of said two lower mounting rods and a respective one of opposite lateral ends of said upper mounting rod.

4. The fitness exercise apparatus of claim 3, wherein each of said two third fixed pulley sets of said transmission unit includes a plurality of third fixed pulleys mounted on said base seat.

5. The fitness exercise apparatus of claim 3, wherein:

said movable pulley set of said transmission unit includes a block, an upper movable pulley fixed on said block, and a lower movable pulley fixed on said block and disposed under said upper movable pulley;

said first cable wraps around said upper movable pulley; and said third cable wraps around said lower movable pulley.

6. The fitness exercise apparatus of claim 1, wherein:

said movable pulley set of said transmission unit includes a block, an upper movable pulley fixed on said block, and a lower movable pulley fixed on said block and disposed under said upper movable pulley;

said first cable wraps around said upper movable pulley; and said third cable wraps around said lower movable pulley.

7. The fitness exercise apparatus of claim 1, wherein:

said support unit includes two guide rods that extend upwardly from said base seat;

said weight subunit of said resistance unit includes a connecting seat that is slidable along said two guide rods, an adjusting rod that extends through said connecting seat, a plurality of weight plates that are slidably sleeved on said two guide rods and said adjusting rod, and an adjusting pin that is inserted removably into a selected one of said plurality of weight plates and said adjusting rod;

said elastic subunit includes two elastic sets that are disposed respectively at opposite sides of said weight subunit;

each of said two elastic sets includes a plurality of elastic strips, each of said plurality of elastic strips having opposite ends that are connected respectively to said connecting seat and said base seat; and numbers of said plurality of elastic strips of said two elastic sets are the same.

8. The fitness exercise apparatus of claim 7, wherein specifications of said plurality of elastic strips of said two elastic sets are identical.

9. The fitness exercise apparatus of claim 1, wherein:

said base seat includes two spaced-apart legs, a plurality of connecting rods that are connected between said two spaced-apart legs, and two retaining members that are respectively connected fixedly to said two spaced-apart legs; and said seat unit includes an inner leg member that is coupled removably to said two retaining members, an outer leg member, a guide rail that is connected between said inner leg member and said outer leg member, and a seat member that is mounted on said guide rail.

10. The fitness exercise apparatus of claim 9, wherein:

said inner leg member of said seat unit includes a stationary tube that is connected transversely to said guide rail, an inner leg rod that is connected telescopically to said stationary tube and that is formed with a plurality of adjusting holes, and an adjusting component that is inserted transversely into said stationary tube and that engages a selected one of said plurality of adjusting holes; and said inner leg rod is inverted T-shaped, and has two arms coupled removably and respectively to said two retaining members of said base seat.

11. The fitness exercise apparatus of claim 9, wherein each of said two spaced-apart legs of said base seat has:

a base segment; and an inclined segment that is transverse to said base segment, that has an inner end connected to said base segment, and an outer end opposite to said inner end, a distance between said inclined segments of said two spaced-apart legs gradually increasing from said inner ends of said inclined segments toward said outer ends of said inclined segments.

* * * * *